US012050079B2

(12) United States Patent
Summers et al.

(10) Patent No.: US 12,050,079 B2
(45) Date of Patent: Jul. 30, 2024

(54) ARCHERY MOUNTING ASSEMBLY AND METHOD

(71) Applicant: QTM, LLC, Madison Heights, VA (US)

(72) Inventors: Daniel A. Summers, Alpine, WY (US); Kevin S. Fry, Madison, VA (US); David Cox, Goode, VA (US); Jason Lynch, Lynchburg, VA (US); Andrew Oliver, Lynchburg, VA (US)

(73) Assignee: QTM, LLC, Madison Heights, VA (US)

( * ) Notice: Subject to any disclaimer, the term of this patent is extended or adjusted under 35 U.S.C. 154(b) by 0 days.

(21) Appl. No.: 18/124,915

(22) Filed: Mar. 22, 2023

(65) Prior Publication Data

US 2023/0221090 A1 Jul. 13, 2023

Related U.S. Application Data

(63) Continuation of application No. 17/179,986, filed on Feb. 19, 2021.

(60) Provisional application No. 62/978,550, filed on Feb. 19, 2020.

(51) Int. Cl.
*F41B 5/14* (2006.01)
*F41B 5/22* (2006.01)

(52) U.S. Cl.
CPC ..... *F41B 5/1403* (2013.01); *F41B 5/14* (2013.01); *F41B 5/143* (2013.01)

(58) Field of Classification Search
CPC .... F41B 5/14; F41B 5/143; F41B 5/06; F41G 1/467
See application file for complete search history.

(56) References Cited

U.S. PATENT DOCUMENTS 3,163,938 A * 1/1965 Reynolds ..... F41G 1/467 33/265
3,389,883 A * 6/1968 Johnson ..... A47F 1/085 248/225.11
3,410,644 A * 11/1968 McLendon ..... F41B 5/1419 359/425
3,574,944 A 4/1971 Reynolds
3,769,956 A * 11/1973 Simo ..... F41B 5/143 124/44.5

(Continued)

OTHER PUBLICATIONS

Ripcord X-Factor; Ripcord Arrow Rest; on or before Sep. 23, 2015; retrieved from the Internet: <http://ripcordarrowrest.com/ripcord-xfactor> , 4 pages.

(Continued)

*Primary Examiner* — John A Ricci
(74) *Attorney, Agent, or Firm* — Barclay Damon LLP

(57) ABSTRACT

An archery mounting assembly and method are disclosed herein. The archery mounting assembly, in an embodiment, includes a mount device having a mount portion configured to be engaged with a body of an archery weapon. The mount device also has a first interface that extends at least partially along an adjustment axis. The archery mounting assembly further includes an accessory support, which includes a support portion configured to support an archery accessory and a second interface configured to be movably coupled to the first interface of the mount device.

29 Claims, 46 Drawing Sheets

(56) References Cited

U.S. PATENT DOCUMENTS 3,844,268 A * 10/1974 Ikeya ..... F41B 5/0042 273/DIG. 7
3,864,836 A * 2/1975 Haines ..... F41G 1/467 33/265
4,136,461 A * 1/1979 Gasser ..... F41G 1/467 33/265
4,585,199 A * 4/1986 Chap ..... A47K 5/02 248/225.11
5,379,746 A 1/1995 Sappington
5,394,858 A 3/1995 Karolian
5,419,154 A * 5/1995 Christoff ..... A45F 3/16 220/709
5,524,601 A * 6/1996 Slates ..... F41B 5/1426 124/87
5,960,779 A 10/1999 Jessee et al.
6,202,635 B1 3/2001 Evans
6,477,778 B1 * 11/2002 Lorocco ..... F41G 1/345 33/265
7,021,301 B2 * 4/2006 Nagle ..... F41B 5/143 124/44.5
7,270,309 B2 * 9/2007 Burns ..... F16M 13/02 248/220.21
9,004,054 B2 * 4/2015 Khoshnood ..... F41B 5/143 124/44.5
9,285,181 B2 3/2016 Green et al.
9,651,330 B1 * 5/2017 LoRocco ..... F41B 5/066
2003/0056379 A1 3/2003 Johnson
2006/0249648 A1 * 11/2006 DeVoe ..... F41B 5/06 248/682
2010/0181454 A1 * 7/2010 Vogt ..... F16M 11/041 248/309.1
2013/0320180 A1 * 12/2013 Castellanos ..... A47B 96/06 248/223.41
2014/0239146 A1 * 8/2014 DiCarlo ..... F16M 13/02 248/682

OTHER PUBLICATIONS

Hamskea Full Capture VersaRest; Hamskea Archery Solutions; on or before Sep. 23, 2015; retrieved from the Internet <http://ripcordarrowrest.com/ripcord-xfactor>; 1 page.

* cited by examiner

ARCHERY MOUNTING ASSEMBLY AND METHOD

CROSS-REFERENCE TO RELATED APPLICATIONS

This application is a continuation of, and claims the benefit and priority of, U.S. patent application Ser. No. 17/179,986 filed on Feb. 19, 2021, which is a non-provisional of, and claims the benefit and priority of, U.S. Provisional Patent Application No. 62/978,550 filed on Feb. 19, 2020. The entire contents of such applications are hereby incorporated herein by reference.

INCORPORATION BY REFERENCE

The entire contents of the following are hereby incorporated into this application by reference: U.S. patent application Ser. No. 16/682,416 filed on Nov. 13, 2019 (now U.S. Pat. No. 10,859,339).

BACKGROUND

Archery accessories, such as arrow rest accessories and sight accessories, have been attached to archery bows in a variety of ways. The position of the known accessory can be adjusted in several dimensions, such as angle, X-position, Y-position and Z-position. For archers, including hunters and target competition archers, the exact position can be very important. Archers, therefore, desire to fine tune the accessory to meet the archers' unique preferences.

In the setup process for one type of accessory, the archer can rotate the holder of the accessory to a desired angle relative to the bow. However, the known archery accessories present difficulties with this process. To adjust the angle, the archer must loosen and detach the holder. The detachment causes the archer to lose the X, Y or Z position setting of the holder. Therefore, when reattaching the holder, the archer must undergo significant time and labor to return to such position setting.

In addition, with repeated use of the bow, the known accessory holder is prone to become loose. This looseness can hamper aiming and cause a loss in the archer's shooting performance.

Also, it is desirable to mount archery accessories on the rear side of the bow's riser. However, in this location, the known archery accessories are not adjustable along an axis that extends through the bow riser.

The foregoing background describes some, but not necessarily all, of the problems, disadvantages and shortcomings related to the known archery accessories.

SUMMARY

An archery mounting assembly, in an embodiment, includes a mount device and an accessory support. The mount device has a mount portion configured to be engaged with the body of an archery weapon. The body is configured to extend at least partially along a vertical plane when the archery weapon is aimed toward a target that extends at least partially along the vertical plane. The mount device also has a first interface that extends at least partially along an adjustment axis. The adjustment axis intersects with the vertical plane when the mount portion is engaged with the body. Also, the adjustment axis is oriented to extend into the body when the mount portion is engaged with the body. The accessory support has a support portion configured to support an archery accessory, and the accessory support has a second interface configured to be movably coupled to the first interface of the mount device. When the mount portion is engaged with the body, the accessory support is configured to be moved, along the adjustment axis, in a plurality of different directions relative to the body.

In another embodiment, the archery mounting assembly includes a mount device and an accessory support. The mount device has a mount portion configured to be engaged with the body of an archery weapon. The mount device also has a first interface that extends at least partially along an adjustment axis. The adjustment axis is oriented to extend into the body when the mount portion is engaged with the body. The accessory support has a support portion configured to support an archery accessory, and the accessory support has a second interface configured to be movably coupled to the first interface of the mount device so that, when the mount portion is engaged with the body, the second interface is configured to be moved, along the adjustment axis, relative to the body.

In another embodiment, a method for manufacturing an archery mounting assembly includes structuring a mount device to have: (a) a mount portion structured to be engaged with a body of an archery weapon; and (b) a first interface that extends at least partially along an adjustment axis, wherein the adjustment axis is oriented to extend into the body when the mount portion is engaged with the body. The method also includes structuring an accessory support to have: (a) a support portion structured to support an archery accessory; and (b) a second interface structured to be movably coupled to the first interface of the mount device so that, when the mount portion is engaged with the body, the second interface is configured to be moved, along the adjustment axis, relative to the body.

In yet another embodiment, an archery accessory system includes either of the archery mounting assemblies described above, wherein the accessory comprises one or more of the following: an arrow rest device, a bow sight device, an arrow quiver device, a stabilizer device, a scope device, a light source device, a sensor, and an energy generator.

In another embodiment, an adapter is usable in conjunction with the body of an archery weapon. The adapter can include an adapter rail, adapter plate or another suitably-configured adapter. The adapter is configured to enable a user to convert the body of the weapon to a shape having one or more mounting slots or securement slots, including, but not limited to, angled slots associated with a dovetail shape. Such adapter is configured to be removably attached or otherwise mounted to the front surface, rear surface, left side surface or right side surface of the body of the archery weapon.

Additional features and advantages of the present disclosure are described in, and will be apparent from, the following Brief Description of the Drawings and Detailed Description.

DETAILED DESCRIPTION

In certain descriptions herein, the references to right and left are used to distinguish between opposing surfaces or views. It is not required or necessary that the described features be present at the right or left. Furthermore, when describing the right and left sides or parts of an object (such as an archery bow), the right and left are determined from the perspective of viewing the front of the object.

Figure 1:
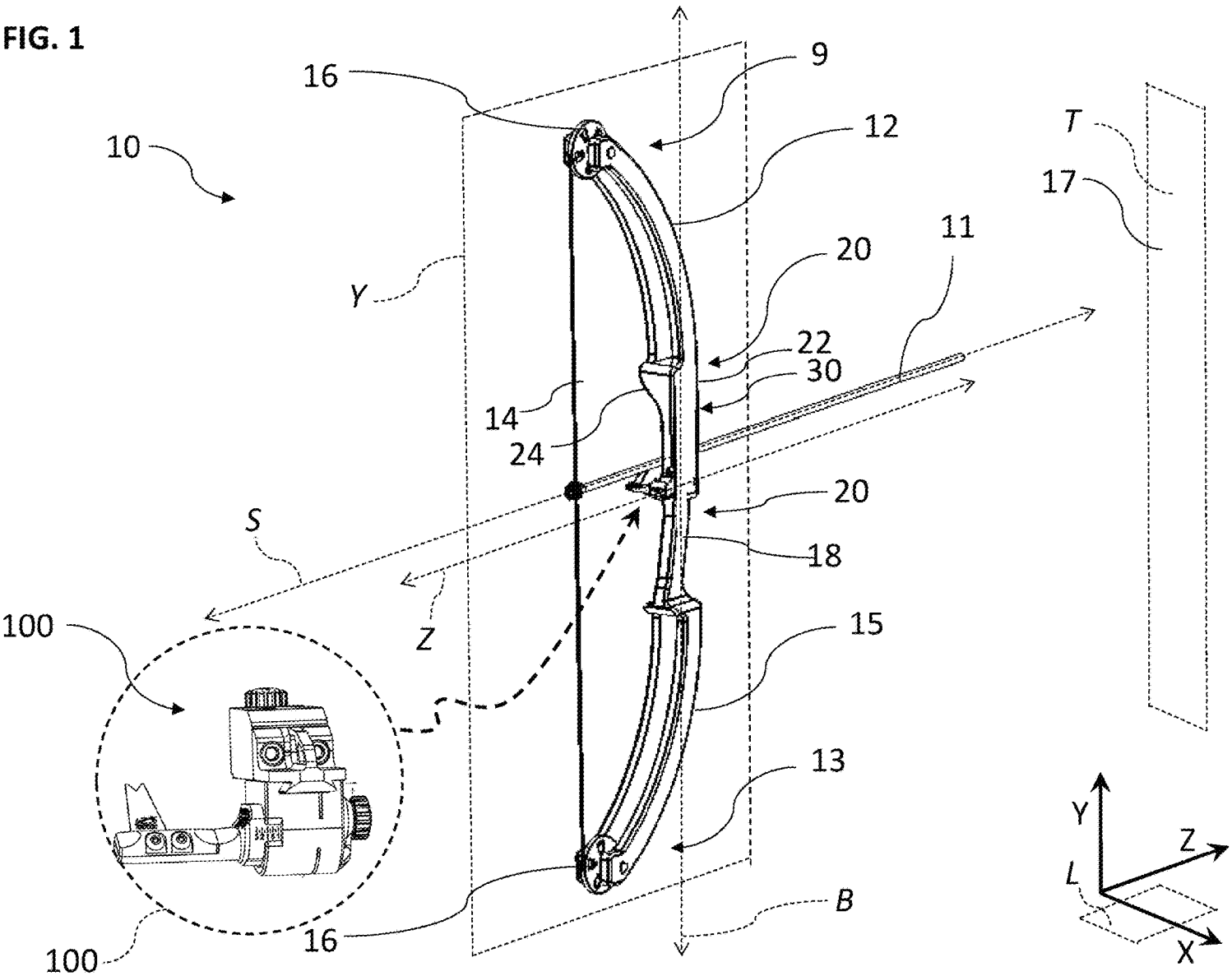
FIG. 1 is a left, isometric view of an embodiment of an archery bow having an embodiment of an archery accessory system mounted to such archery bow.
Figure 2:
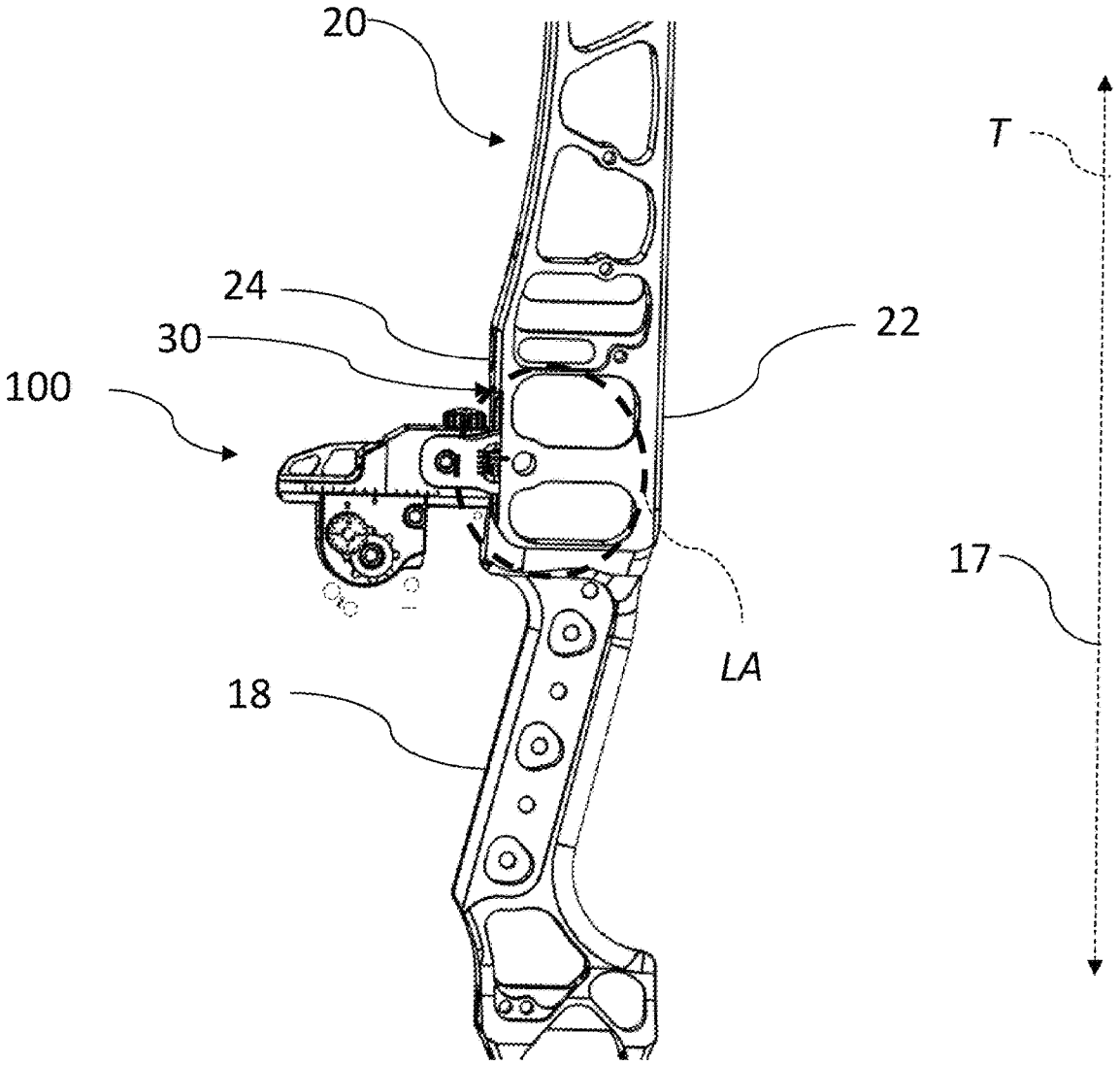
FIG. 2 is left side elevation view of the archery bow of FIG. 1.
Figure 3:
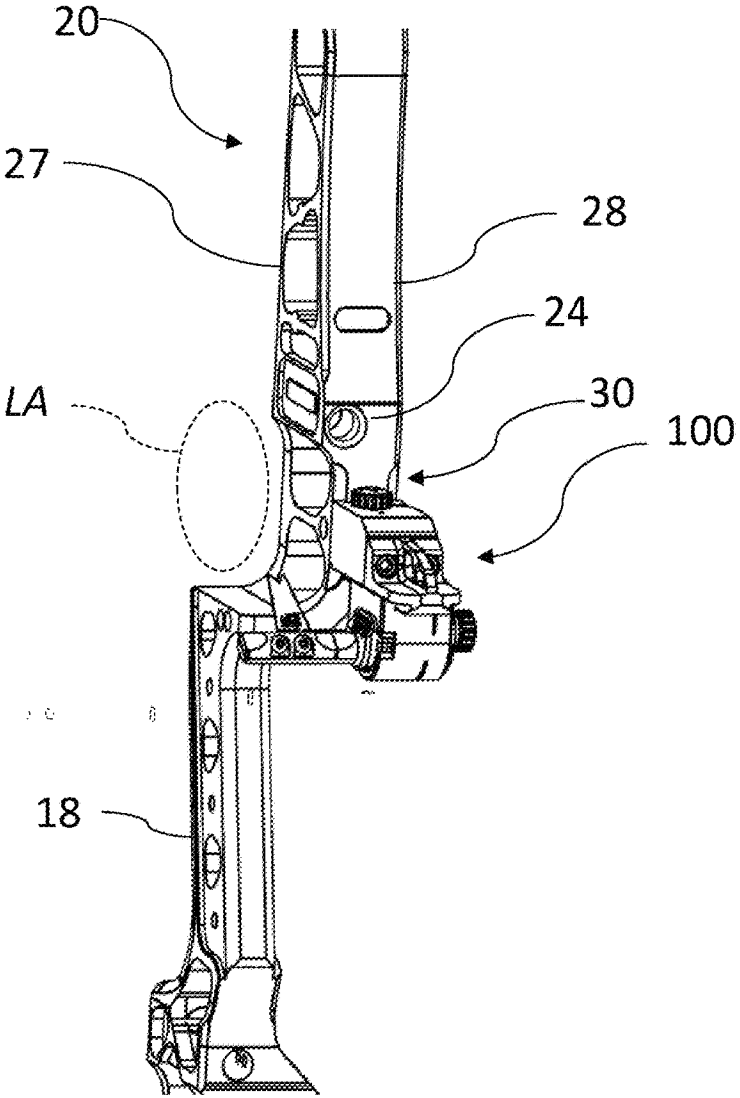
FIG. 3 is a rear, isometric view of the archery bow of FIG. 1.

Referring to FIGS. 1-3, in an embodiment, the archery bow 10 (an example of an archery weapon) includes an archery structure, bow riser, limb support or weapon body 20. The weapon body 20 includes a grasp structure, handle section or handle 18. A first limb 12 extends upward from the weapon body 20 towards a top 9 of the archery bow 10, and a second limb 15 extends downward from the handle 18 toward the bottom 13 of the archery bow 10. Each of the limbs 12, 15 is coupled to at least one rotor 16. Depending on the embodiment, the rotor 16 can be a circular pulley having a circular cord engagement portion or an eccentric member or cam that has one or more asymmetric cord engagement portions. A bowstring or draw cord 14 extends between the upper and lower rotors 16. A shooting plane Y extends through the vertical-extending segment of the cord 14. As shown in FIG. 1, at least part of the archery bow 10 extends along a bow axis B. In particular, the bow axis B extends through at least part of the weapon body 20, and the bow axis B is parallel or substantially parallel to the shooting plane Y.

In the embodiment shown in FIG. 1, the archery bow 10 is a vertical, compound archery bow having two rotors 16, and the archery accessory system 100. As described below, the archery accessory system 100 is configured to support a projectile 11. It should be appreciated that, depending upon the embodiment, part or all of the weapon body 20 can be a part of (or unitarily integrated into) other types of archery weapons or shooting equipment, including, but not limited to, crossbows, recurve bows, fishing bows, weapons, rifles and firearms. Likewise, the archery accessory system 100 is usable with, and configured to be mounted to, the body, stock, frame or structure of any such type of archery weapon or shooting equipment.

Still referring to FIGS. 1-3, an archery arrow or projectile 11 is positioned in or on the archery accessory system 100 so that the projectile 11 extends along a shooting axis S that is directed toward a target 17 extending upward in a target plane T. As shown in FIGS. 1-3, the weapon body 20 further includes a forward facing surface or front surface 22 that faces the target plane T and a rearward facing surface or rear surface 24 that faces away from the target plane T. Referring to FIGS. 2-3, a launching space or launching area LA is located proximate a right or inner side surface 27 (FIG. 3) of the weapon body 20. A left or outer side surface 28 is positioned opposite the inner side surface 27 and configured to face in a direction opposite of the inner side surface 27.

In the illustrated embodiment, the weapon body 20 includes a body mounting portion 30 that is configured to be coupled to the archery accessory system 100. The body mounting portion 30 causes the weapon body 20 to be matingly compatible with the archery accessory system 100. The body mounting portion 30 includes one or more mounting surfaces configured to cooperate with the archery accessory system 100 to adjustably mount the archery accessory system 100 to the body mounting portion 30 of the weapon body 20.

In the embodiments shown in FIGS. 1-3, the body mounting portion 30 is integrally coupled to, and extends from, the handle 18 so as to form an integral or unitary structure with the handle 18. Also, the handle 18 and body mounting portion 30 are integral with the weapon body 20, forming a unitary structure. Depending upon the embodiment, the handle 18, the body mounting portion 30 and the weapon body 20 can be integrally constructed of a unitary structure.

Figure 3A:
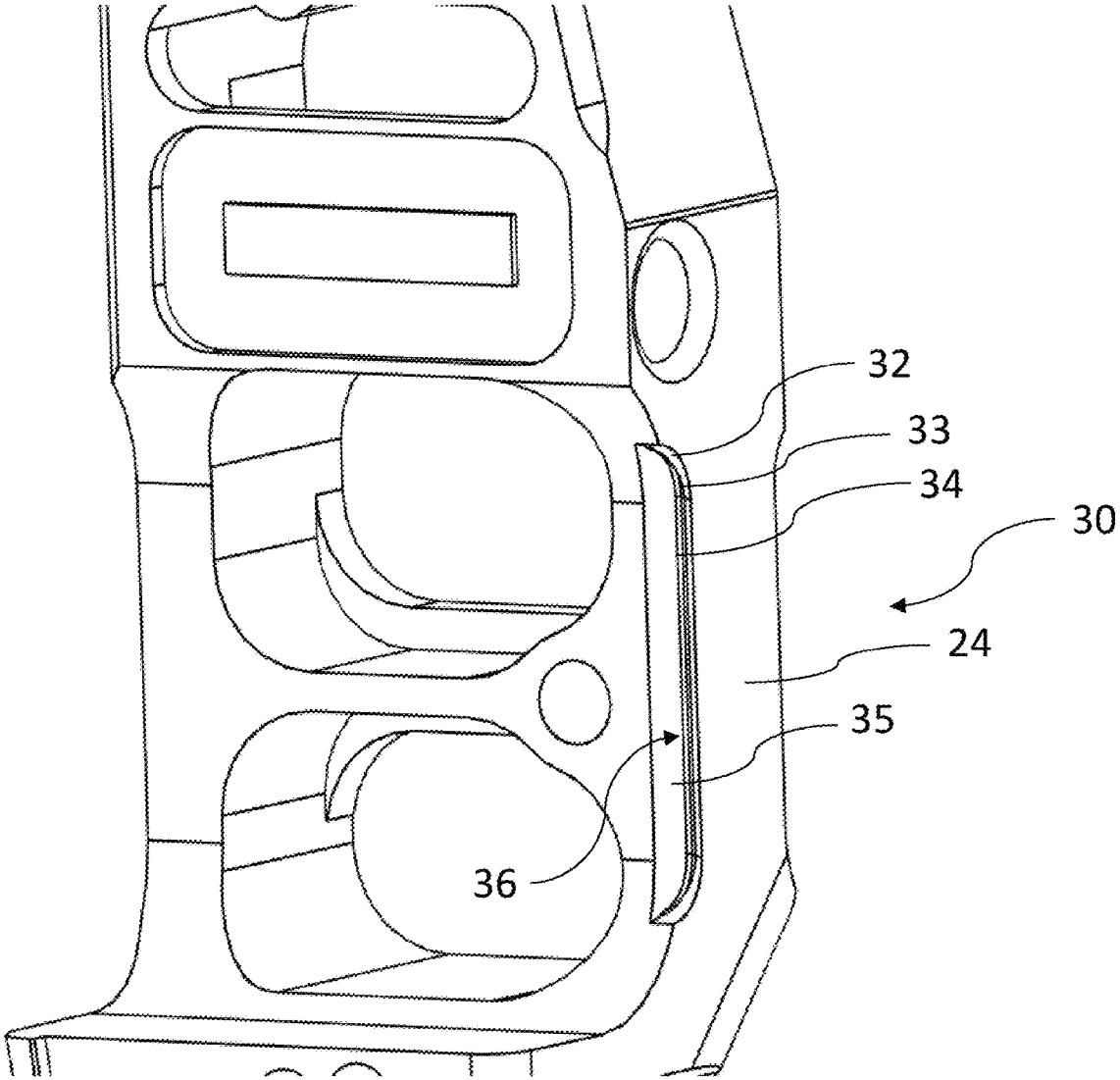
FIG. 3A is an enlarged, right, isometric view of the mounting portion of the archery bow of FIG. 1.
Figure 3B:
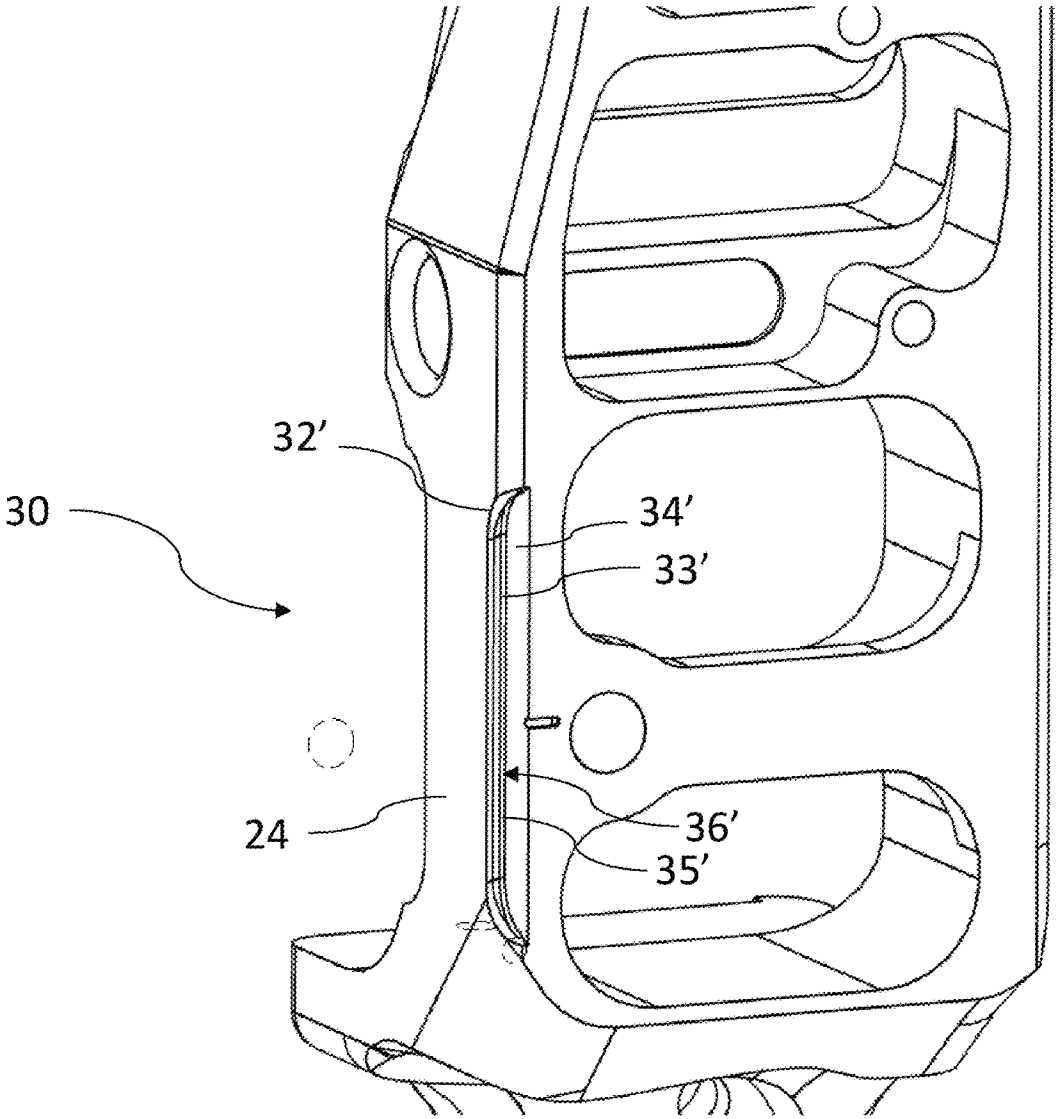
FIG. 3B is an enlarged, left, isometric view of the mounting portion of the archery bow of FIG. 1.
Figure 3C:
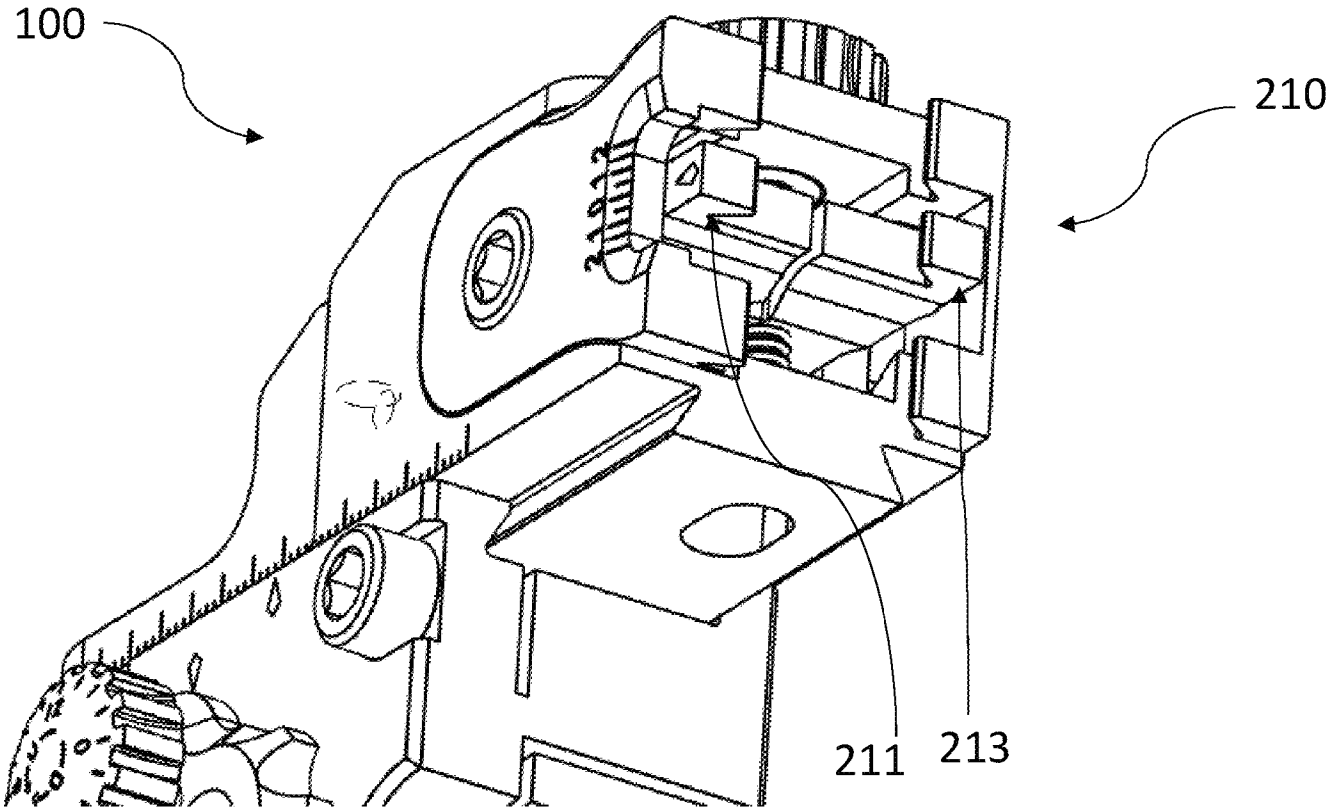
FIG. 3C is a front, isometric view of the archery accessory system of FIG. 1, illustrating the clamp assembly of such archery accessory system.

As shown in FIGS. 3A and 3C, the body mounting portion 30 defines a plurality of right mount surfaces 32, 33, 34, 35, and a plurality of left mount surfaces 32', 33', 34', 35'. The right mount surfaces 32, 33, 34, 35 extend along intersecting planes, and the left mount surfaces 32', 33', 34', 35' extend along intersecting planes. The right mount surfaces 32, 33, 34, 35 define a right cavity or right slot 36, and the left mount surfaces 32', 33', 34', 35' define a left cavity or left slot 36'. The rearward facing surface or rear surface 24, the right slot 36, and the left slot 36' collectively define a dovetail shape configured for slidably mating with the clamp portions 211, 213 of the positioning clamp assembly 210 of archery accessory system 100, as shown in FIG. 3C. In an embodiment, the body mounting portion 30 and the positioning clamp assembly 210 have the same structure, geometry, shape, functionality, elements, characteristics and advantages as the mounting portion and clamp assembly disclosed, illustrated and described in U.S. patent application Ser. No. 16/682,416 filed on Nov. 13, 2019 (now U.S. Pat. No. 10,859,339), the entire contents of which are hereby incorporated by reference, as set forth above.

Figure 3D:
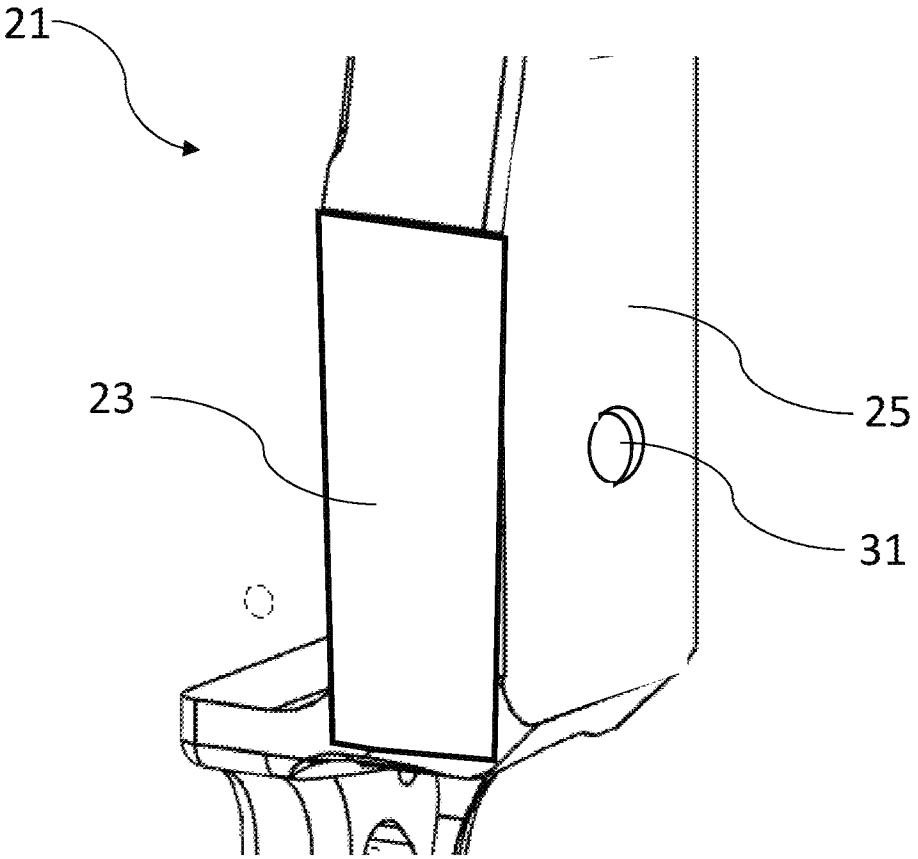
FIG. 3D is a rear, isometric view of an embodiment of a rear surface of a weapon body.
Figure 3E:
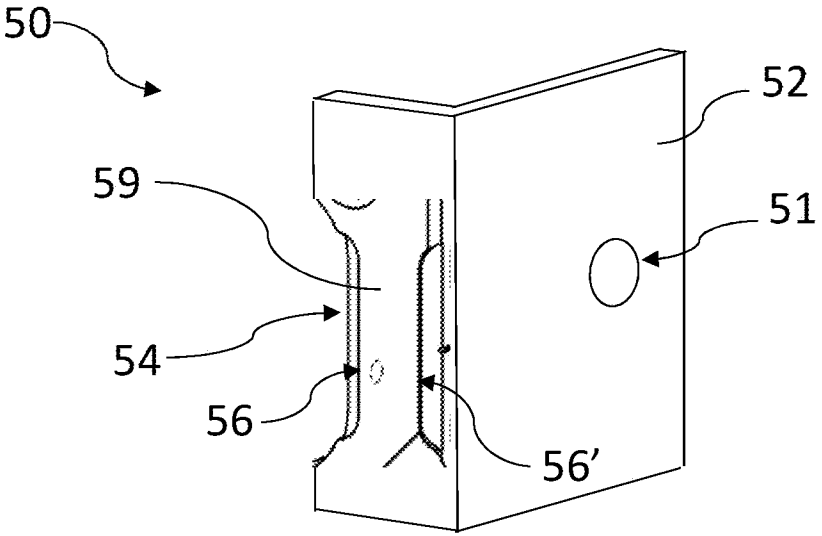
FIG. 3E is a rear, isometric view of an embodiment of an adapter configured to be coupled to the weapon body of FIG. 3D.
Figure 3F:
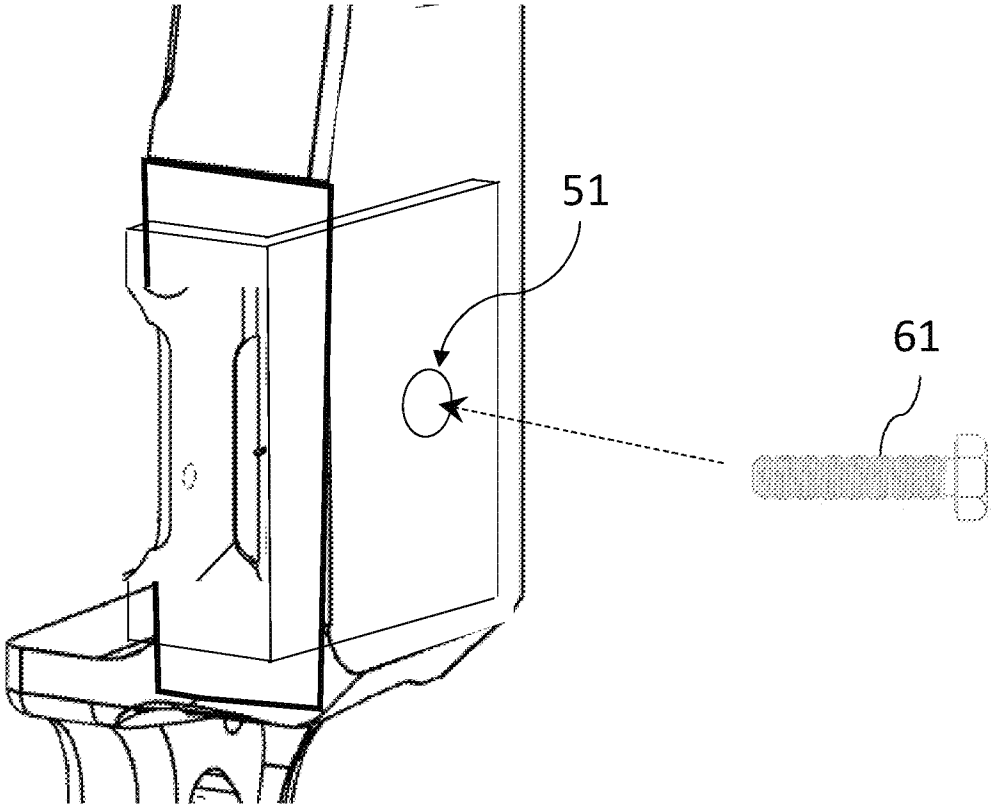
FIG. 3F is a rear, isometric view of the weapon body of FIG. 3D having the adapter of FIG. 3E attached to such weapon body.

In another embodiment illustrated in FIGS. 3D-3F, the body mounting portion 30 constitutes, includes or is connectable to a kit, accessory, component or adapter 50 separable from the weapon body 21. In this embodiment, the weapon body 21 has a rear surface 23 and a left or outer side surface 25. Unlike weapon body 20, weapon body 21 does not define a right slot 36 or left slot 36'. The outer side surface 25 defines one or more thread mounting holes, such as mounting hole 31.

Figure 4:
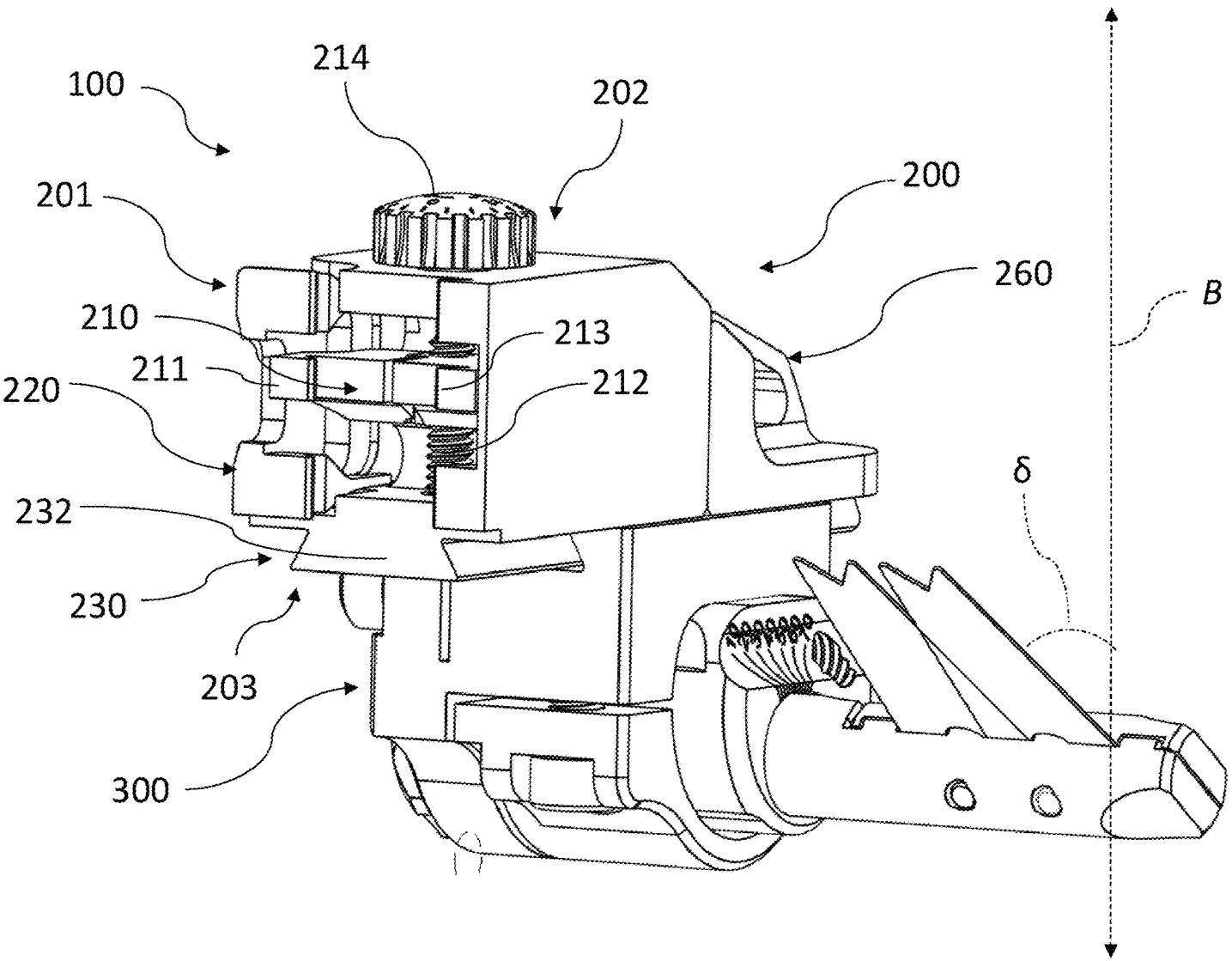
FIG. 4 is another front, isometric view of the archery accessory system of FIG. 1.

As shown in FIG. 3E, the adapter 50 includes a side portion 52 that defines an adapter hole 51, and the adapter 50 includes a rearward portion 54. The rearward portion 54 includes a rearward facing surface 59, and the rearward portion 54 defines a left slot 56 and a right slot 56'. The rearward facing surface 59, the left slot 56, and the right slot 56' collectively define a dovetail shape configured for slidably mating with the clamp portions 211, 213 of the positioning clamp assembly 210 (FIGS. 3C and 4). Referring to FIG. 3F, to attach the adapter 50 to the weapon body 21, an installer or user can inserting a bolt or other fastener 61 through the adapter hole 51 and into the mounting hole 31, screwing the fastener 61 until the adapter 50 is securely mounted to the weapon body 21. Accordingly, the adapter 50 enables a user to convert a weapon body 21 to a shape associated with the weapon body 20 so that the user can mount and position the archery accessory system 100 adjacent to, and at least partially rearward of, the rear surface 23 of the weapon body 21.

Referring back to FIGS. 2-3, the body mounting portion 30 is positioned on the rear surface 24 facing the archer, however in other embodiments, the body mounting portion 30 may be located on another side, surface or face of the weapon body 20 or 21.

In the embodiment shown, the archery accessory system 100 includes an arrow rest device of the fall-away type. As illustrated in FIGS. 1 and 4, the archery accessory system 100 includes: (a) a mount device 200; and (b) a launcher, arrow guide or projectile support device 300 that is movably coupled to the mount device 200. The archery accessory system 100 is positioned on the archery bow 10 such that the projectile support device 300 supports the projectile 11 (FIG. 1), keeping the projectile 11 positioned along the shooting axis S before the projectile 11 is launched. It should be appreciated that the projectile support device 300 can be replaced with a different type of accessory support. In such case, the archery accessory system 100 can be a sight accessory system, bow stabilizer accessory system, flashlight accessory system or any other type of archery accessory system.

Figure 5:
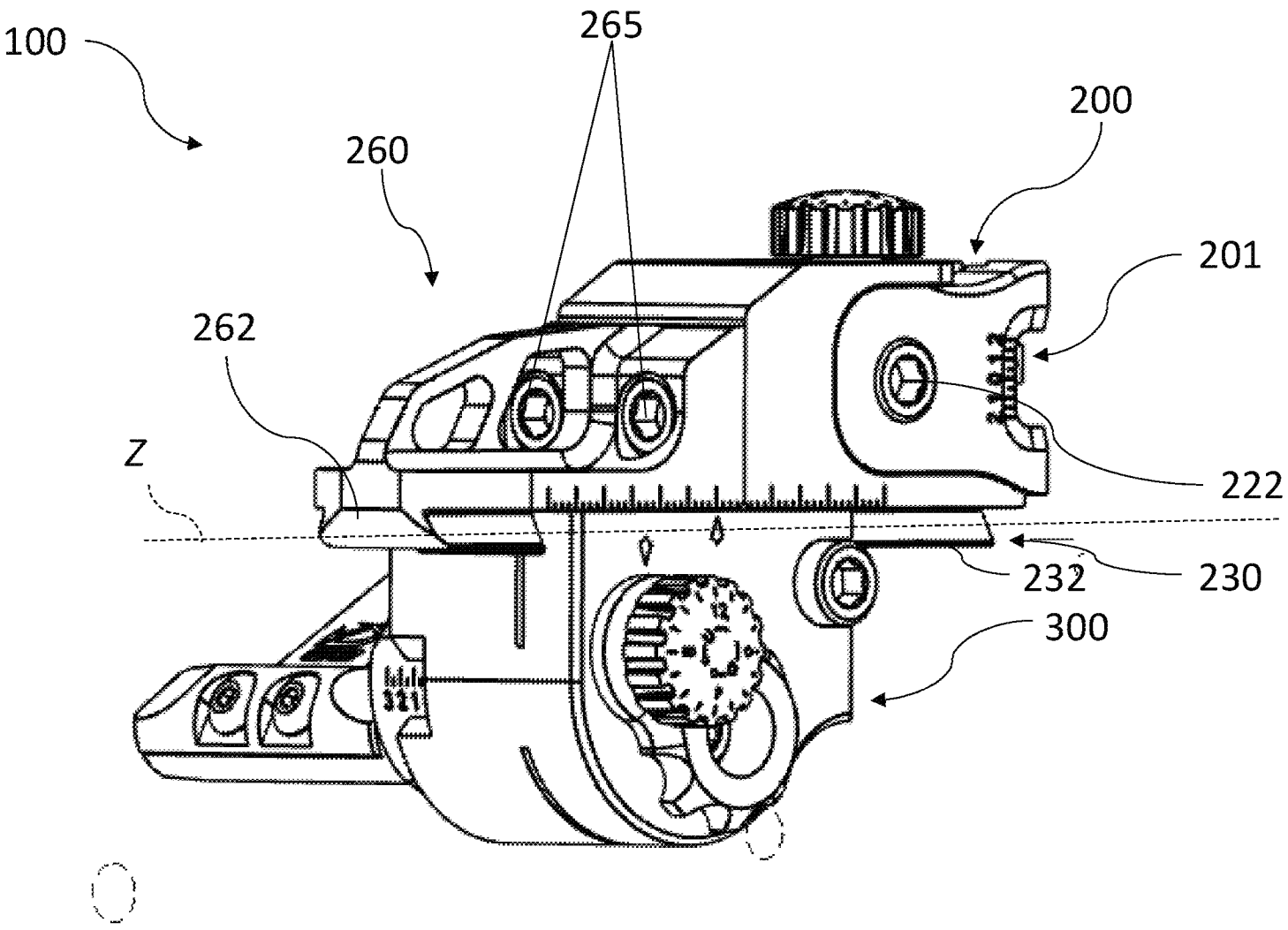
FIG. 5 is a rear, isometric view of the archery accessory system of FIG. 1, illustrating the adjustment axis Z.

Referring to FIGS. 3C, 4 and 5, the bow mount or mount device 200 has a top 202, a bottom 203, a body mount portion 201 configured to engage the body mounting portion 30, and a vertical adjuster 212. In the embodiment shown, the body mount portion 201 includes the positioning clamp assembly 210 and a locking clamp assembly 220 that are configure to cooperate with the body mounting portion 30 to adjustably couple the mount device 200 to the archery bow 10 (FIG. 1). The positioning clamp assembly 210 includes first and second clamp portions 211, 213 and is configured to be transitioned between a coupled position and an uncoupled positioned. In the coupled position, the positioning clamp assembly 210 engages the body mounting portion 30 and inhibits movement of the mount device 200 relative to the body mounting portion 30. The locking clamp assembly 220 includes a locking clamp driver 222 configured to move the locking clamp assembly 220 between a locked and an unlocked position. In the locked position, the locking clamp assembly 220 assembly is configured to inhibit movement of the mount device 200 when the positioning clamp assembly 210 is in the uncoupled position. The adjuster 212 includes an adjuster grasp 214. When the positioning clamp assembly 210 is in the uncoupled position, the user can rotate the adjuster grasp 214, which will cause the archery accessory system 100 to move relative to the archery bow 10 (upward or downward) along the X axis (FIG. 1), as further described in U.S. patent application Ser. No. 16/682,416 (now U.S. Pat. No. 10,859,339), which is incorporated herein by reference, as set forth above.

Figure 6:
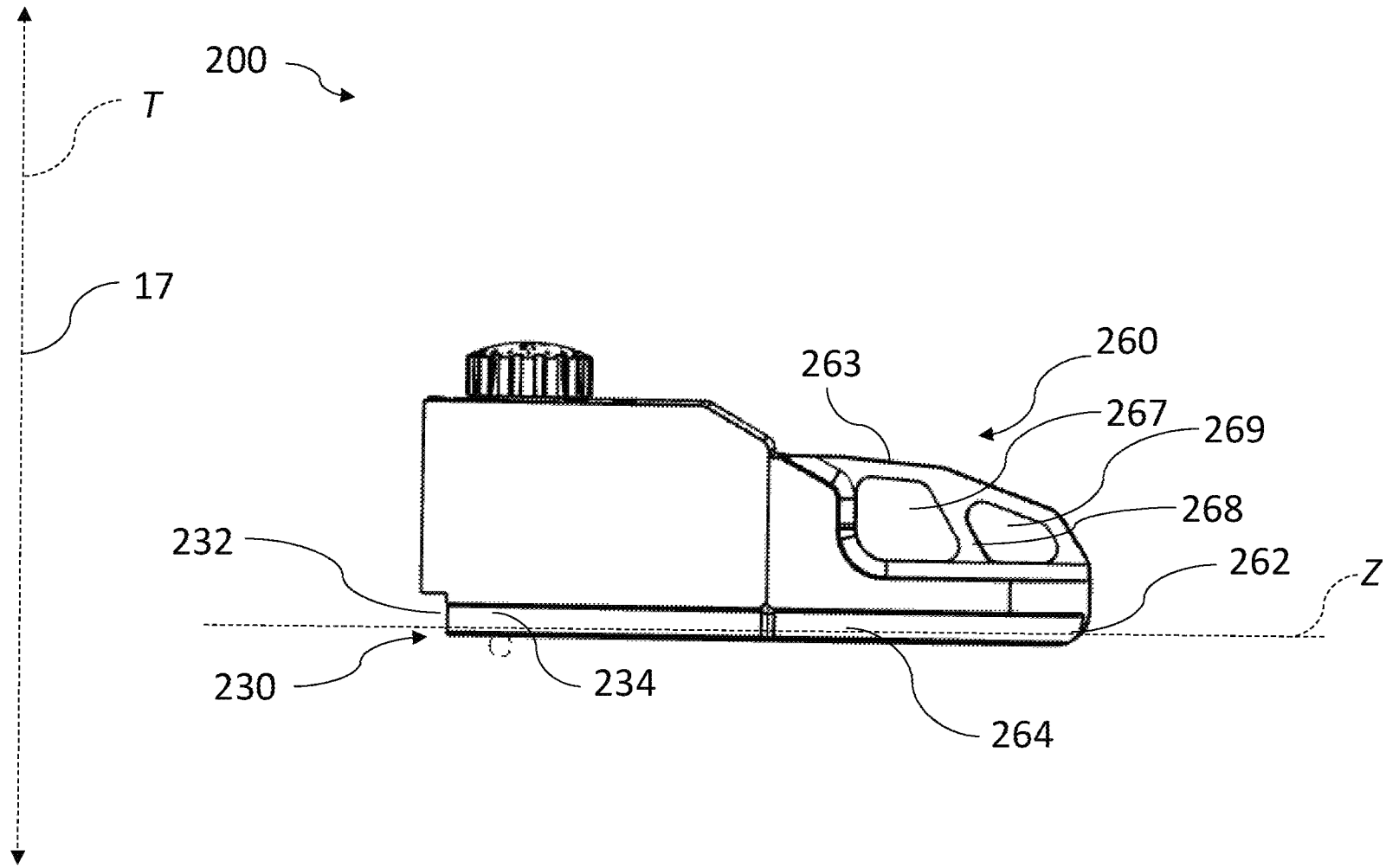
FIG. 6 is a right side elevation view of an embodiment of the mount device of the archery accessory system of FIG. 1.
Figure 7:
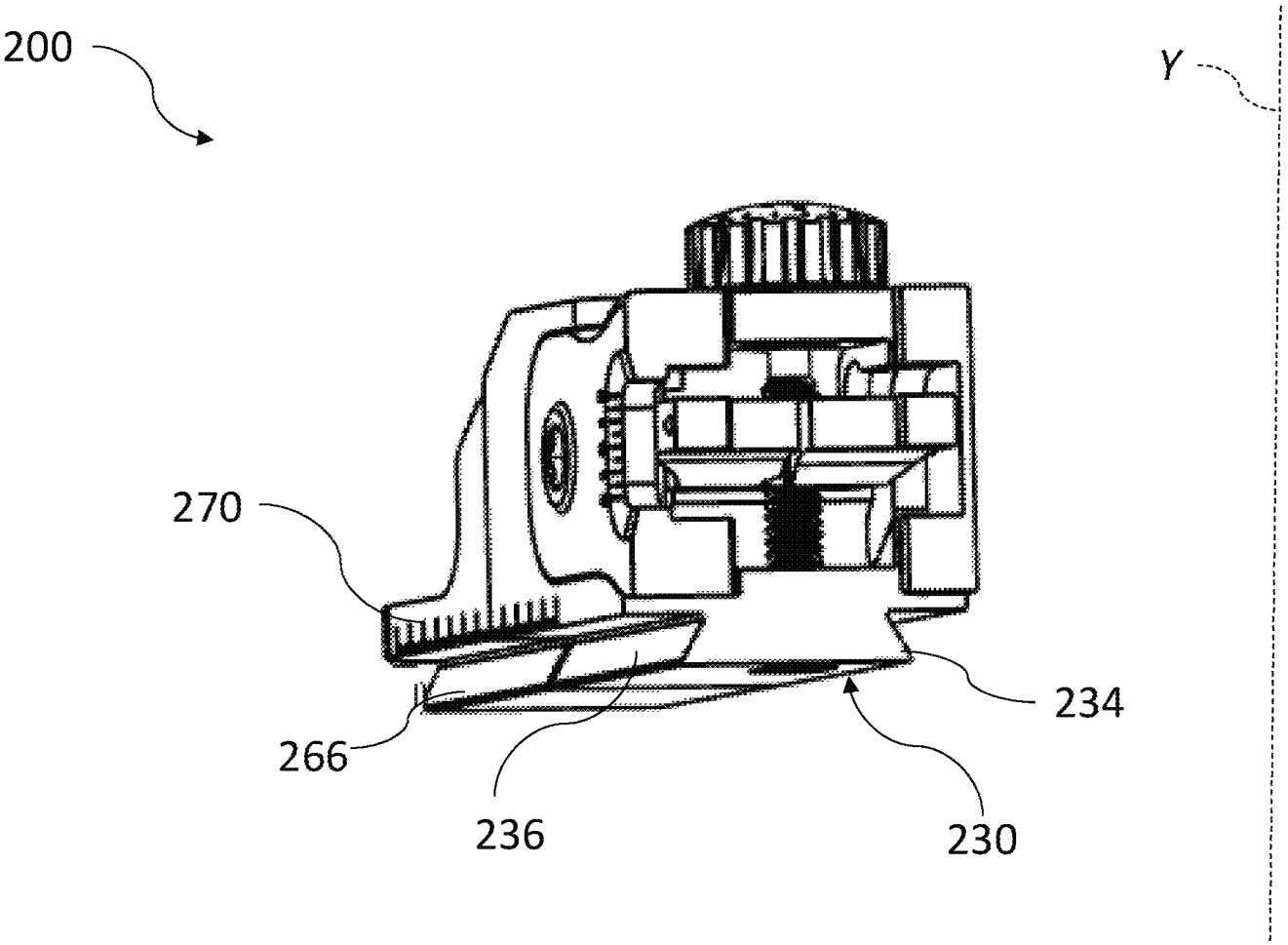
FIG. 7 is a front, isometric view of an embodiment of the mount device of the archery accessory system of FIG. 1.

The archery accessory system 100 also includes a first interface 230 positioned at the bottom 203 of the mount device 200. As shown in FIGS. 4-7, the first interface 230 includes a male dovetail-shaped portion 232 extending along an adjustment axis Z that intersects the target plane T when the mount device 200 is installed onto the weapon body 20 or 21. A shown in FIG. 1, the adjustment axis Z extends into and through the weapon body 20. The male dovetail-shaped portion 232 of the first interface 230 is formed by a first outwardly oriented lip, protrusion or extension surface 234 and a second outwardly oriented lip, protrusion or extension surface 236 positioned opposite the first extension surface 234. As shown in FIG. 7, each of the extension surfaces 234, 236 extends along a slanted or angled plane that intersects with the shooting plane Y.

In the illustrated embodiment, the mount device 200 has a mount interface extension 260. The mount interface extension 260 extends or increases the length of the first interface 230. The mount interface extension 260 provides support for counteracting the weight and pulling forces applied by the projectile support device 300 to the mount device 200. As shown in the embodiment of FIG. 5-6, the mount interface extension 260 may be coupled to the mount device 200 using one or more fasteners 265. In other embodiments, the mount interface extension 260 may be coupled to the mount device 200 through the interaction of cooperating mating surfaces present on the mount interface extension 260 and the mount device 200. The mount interface extension 260 includes a male dovetail-shaped portion extension 262 configured to align with and extend the male dovetail-shaped portion 232 of the first interface 230. In an embodiment, there is a kit having a plurality of mount interface extensions 260 of different lengths.

Accordingly, the male dovetail-shaped portion extension 262 is formed by a first outwardly oriented lip, extension surface or first lip 264, and a second outwardly oriented lip or extension surface 266 positioned opposite the first lip 264. A mount interface extension support 263 may extend along a side of the mount interface extension 260 that is opposite the male dovetail-shaped portion extension 262. As shown in FIG. 6, the mount interface extension support 263 includes one or more beams or trusses 268 defining a plurality of gaps or openings 267, 269 which traverse the mount interface extension support 263. The openings 267, 269 reduce the overall weight of the mount device 200. One or more Z axis measurement or adjustment markings 270 may be formed, marked or placed on the mount device 200 proximate the second outwardly oriented lip or extension surfaces 236, 266 for the purposes of repeatedly adjusting the archery accessory system 100 along the Z axis to fine tune the archery bow 10. As described further below, in an embodiment, a user can manually push or pull the projectile support device 300 to reposition the projectile support device 300 along the Z axis. In another embodiment, not shown, the archery accessory system 100 includes a Z axis adjuster, including a driver and a grasp connected thereto. Such Z axis adjuster is configured to enable a user to perform incremental movements of the projectile support device 300 along the Z axis by rotating such grasp.

Figure 8:
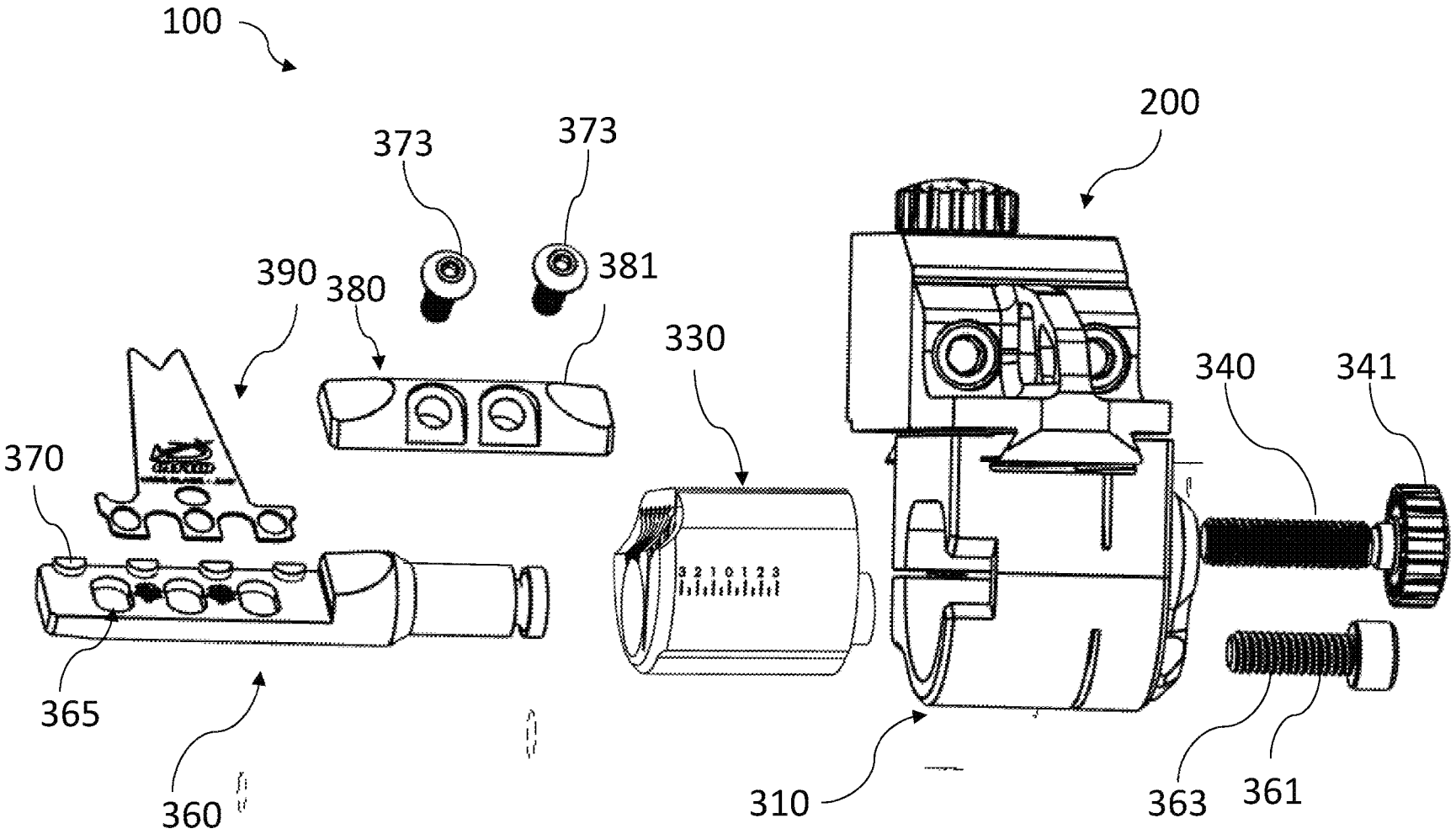
FIG. 8 is an exploded, rear, isometric view of the archery accessory system of FIG. 1.
Figure 9:
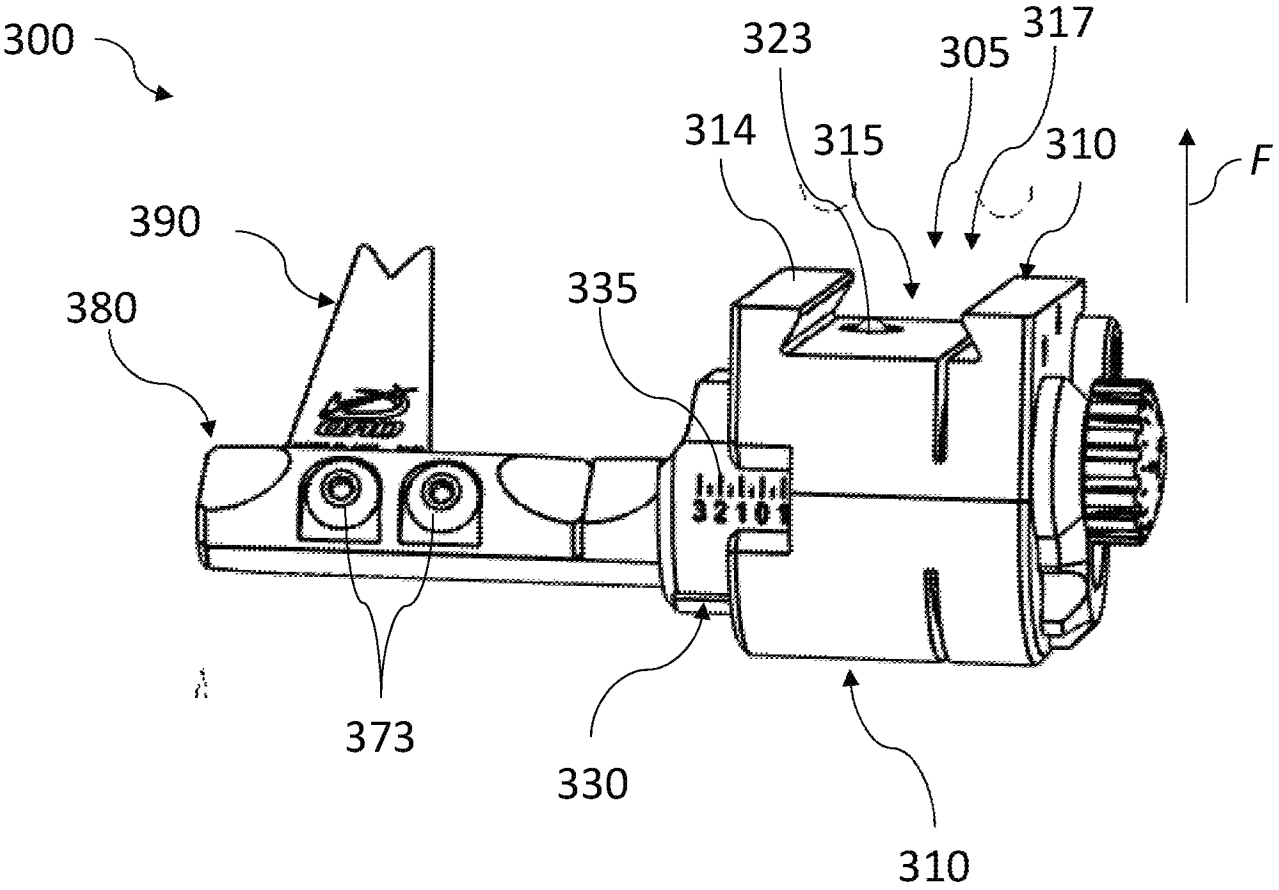
FIG. 9 is a rear, isometric view of an embodiment of the projectile support device of the archery accessory system of FIG. 1.
Figure 10:
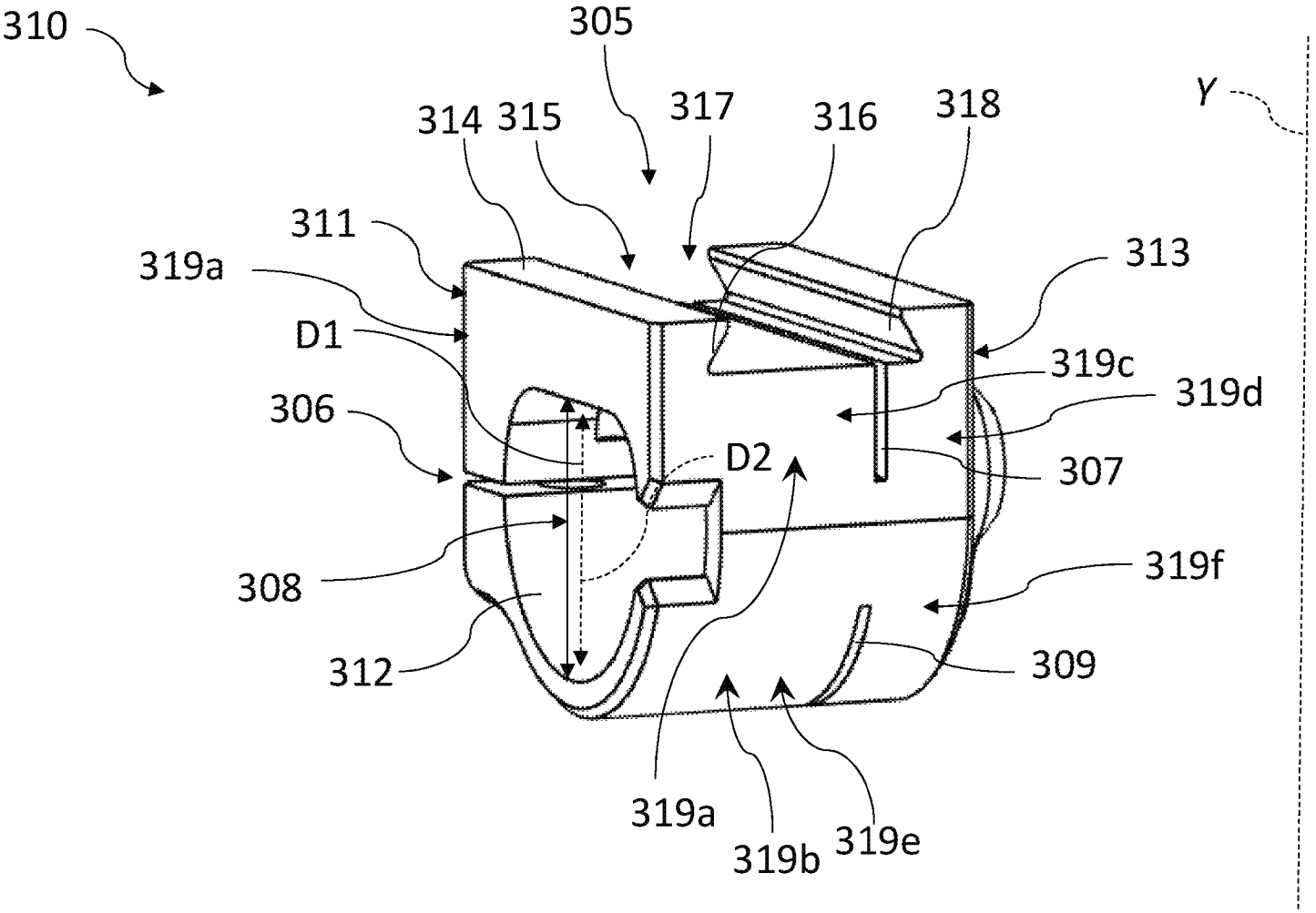
FIG. 10 is a top, isometric view of the support of the projectile support device of the archery accessory system of FIG. 1.
Figure 11:
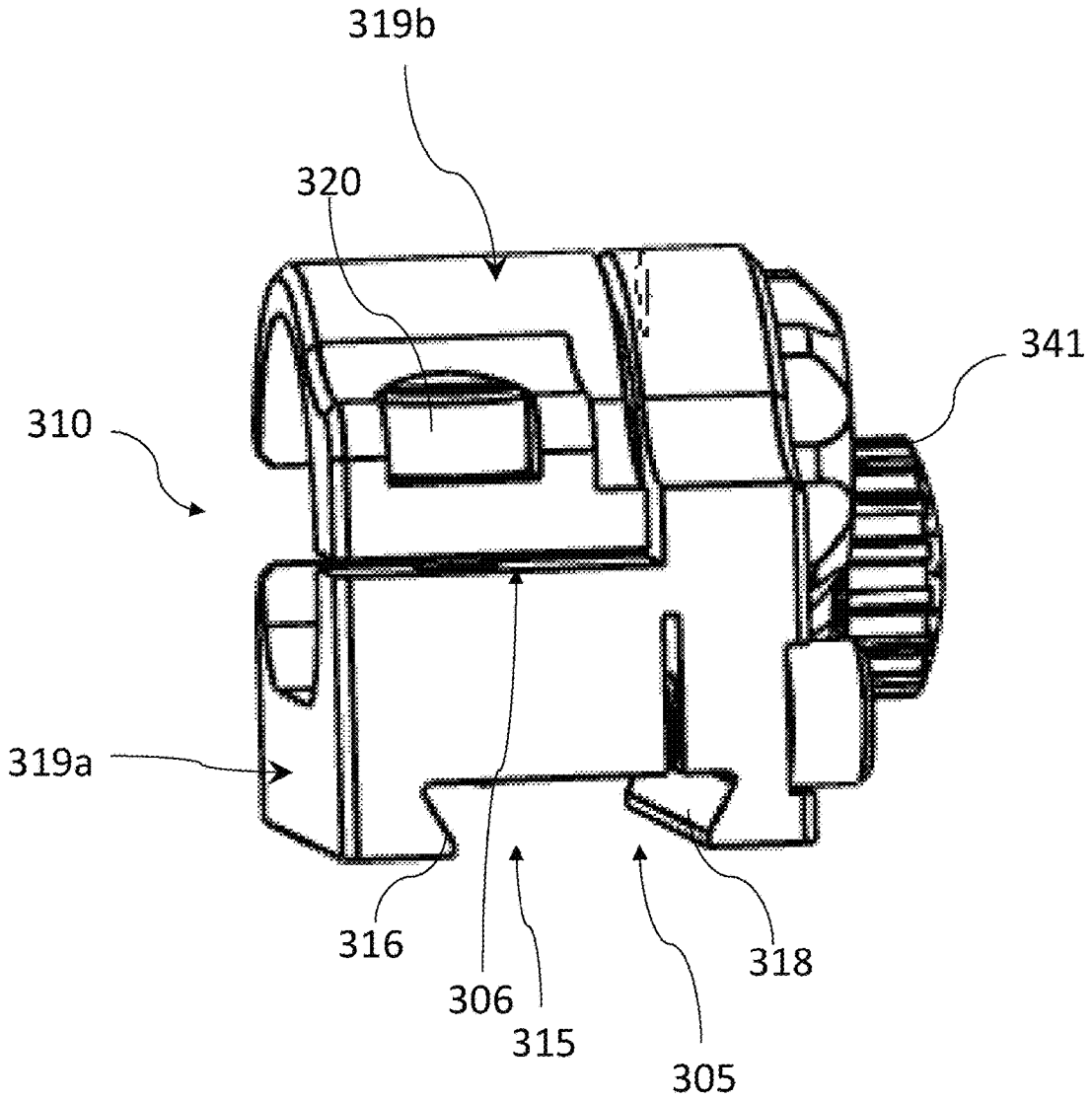
FIG. 11 is a bottom, isometric view of the support of the projectile support device of the archery accessory system of FIG. 1.

Referring to FIGS. 8-12, the projectile support device 300 is configured to be coupled to the first interface 230 of the mount device 200. The projectile support device 300 includes a support 310 having a forward end 311 and a rearward end 313 and a first inner surface 312 extending from the forward end 311 to the rearward end 313. A top surface 314 of the support defines a second interface 305 configured to mate with and engage the first interface 230 of the mount device 200. In the embodiment shown, the second interface 305 includes a female dovetail-shaped portion 317 formed by a first inwardly lip or extension surface 316 and a second inwardly oriented lip or extension surface 318, which together define a cavity, recess or opening 315 corresponding to the shape of the male dovetail-shaped portion 232 of the first interface 230 of the mount device 200. As shown in FIG. 10, each of the extension surfaces 316, 318 extends along a slanted or angled plane that intersects with the shooting plane Y.

Referring to FIG. 9, the support 310 includes a biasing member 323 positioned within the opening 315. In an embodiment, the biasing member 323 includes a dome-shaped pin and a spring coupled to such pin. The biasing member 323 is configured to exert a force in a direction F to press the extension surfaces 316, 318 of the female dovetail-shaped portion 317 against the extension surfaces 234, 236 of the male dovetailed-shaped portion 232. Such biasing force increases the friction between the second interface 305 and the first interface 230. This friction maintains the Z axis position of the projectile support device 300 relative to the mount device 200.

As described, the projectile support device 300 may be moved or slid along the Z axis by sliding the projectile support device 300 relative to the mount device 200 such that the female dovetail-shaped portion 317 moves or slides along or relative to the male dovetail-shaped portion 232 of the first interface 230. In other embodiments, the first interface 230 includes a female dovetail-shaped portion and the second interface 305 includes a male dovetailed-shaped portion. It should be appreciated that the projectile support device 300 can be slidably coupled to the mount device 200 through any slot-and-groove arrangement or any other suitable coupling arrangement.

Figure 12:
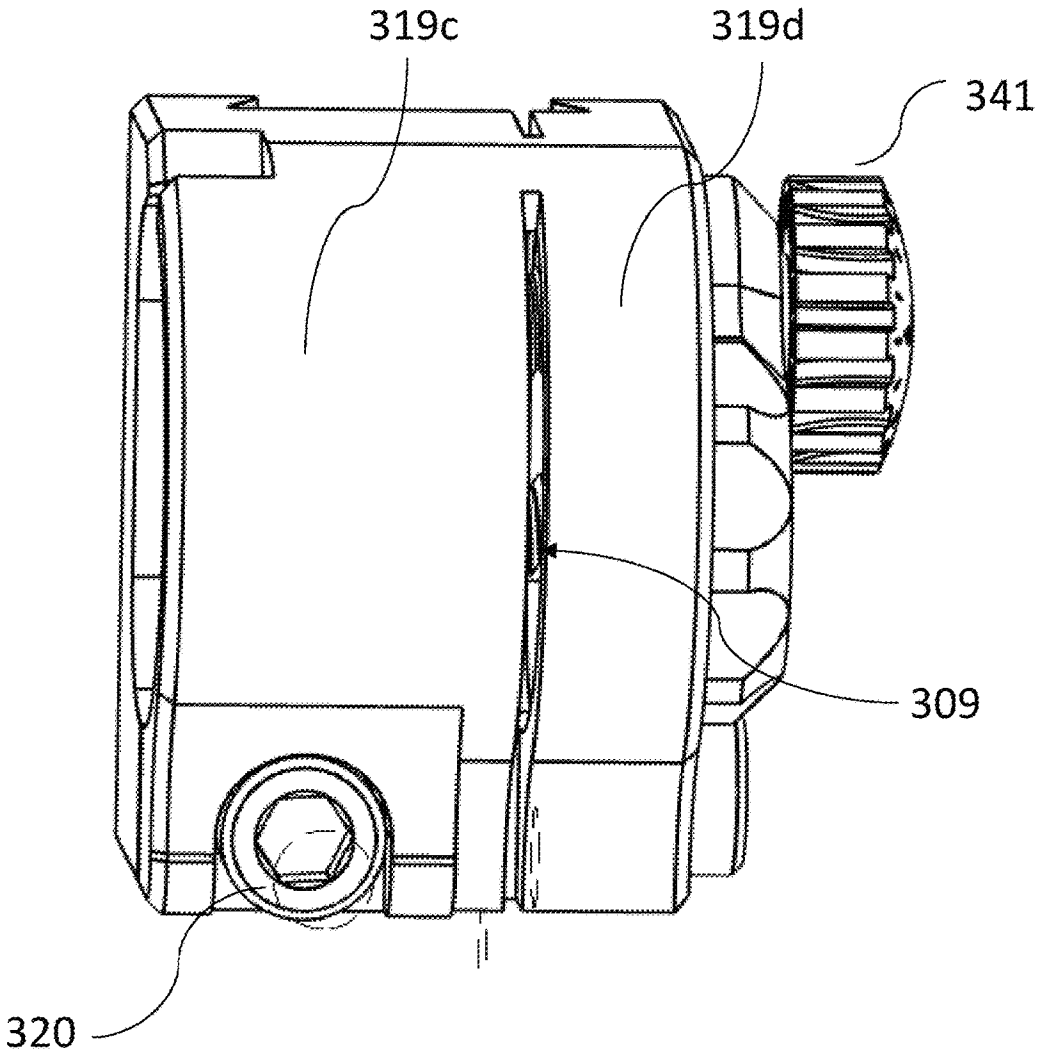
FIG. 12 is another isometric view of the support of the projectile support device of the archery accessory system of FIG. 1, illustrating one of the compression cavities.

As illustrated in FIGS. 10 and 12, the support 310 further includes: (a) a plurality of support portions 319*a* and 319*b* separated or partially separated by a flex space, compression channel or a compression cavity 306; (b) a plurality of support portions 319*c*, 319*d* separated or partially separated by a flex space, compression channel or a compression cavity 307; and (c) a plurality of support portions 319*e*, 319*f* separated or partially separated by a flex space, compression channel or a compression cavity 309. The compression cavity 306 facilitates the flexing of the support 310 for compression onto the intermediary device 330, as described below. The compression cavities 307, 309 facilitate the flexing of the support 310 for receiving the male dovetail-shaped portion 232 of the first interface 230. In an embodiment not shown, the support 310 includes one more fasteners (e.g., bolts or screws) that extend through into the support 310, extending across the compression cavities 307, 309. A user can screw or rotate such fasteners to bring portions 319*c*, 319*d* closer together and to bring 319*e*, 319*f* closer together. Doing so secures or locks the Z axis position of the projectile support device 300 relative the mount device 200.

A support cavity 308 is defined by the first inner surface 312 and includes a first diameter D1. The first inner surface 312 may define one or more surface features such as grooves, ridges, encroachments, or depressions. A securing member 320 is configured to extend at least partially into the compression cavity 306. The securing member 320 is further configured to be manipulated and moved relative to the support 310 to decrease the width of the compression cavity 306 resulting in a second diameter D2 that is less than the first diameter D1.

Figure 13A:
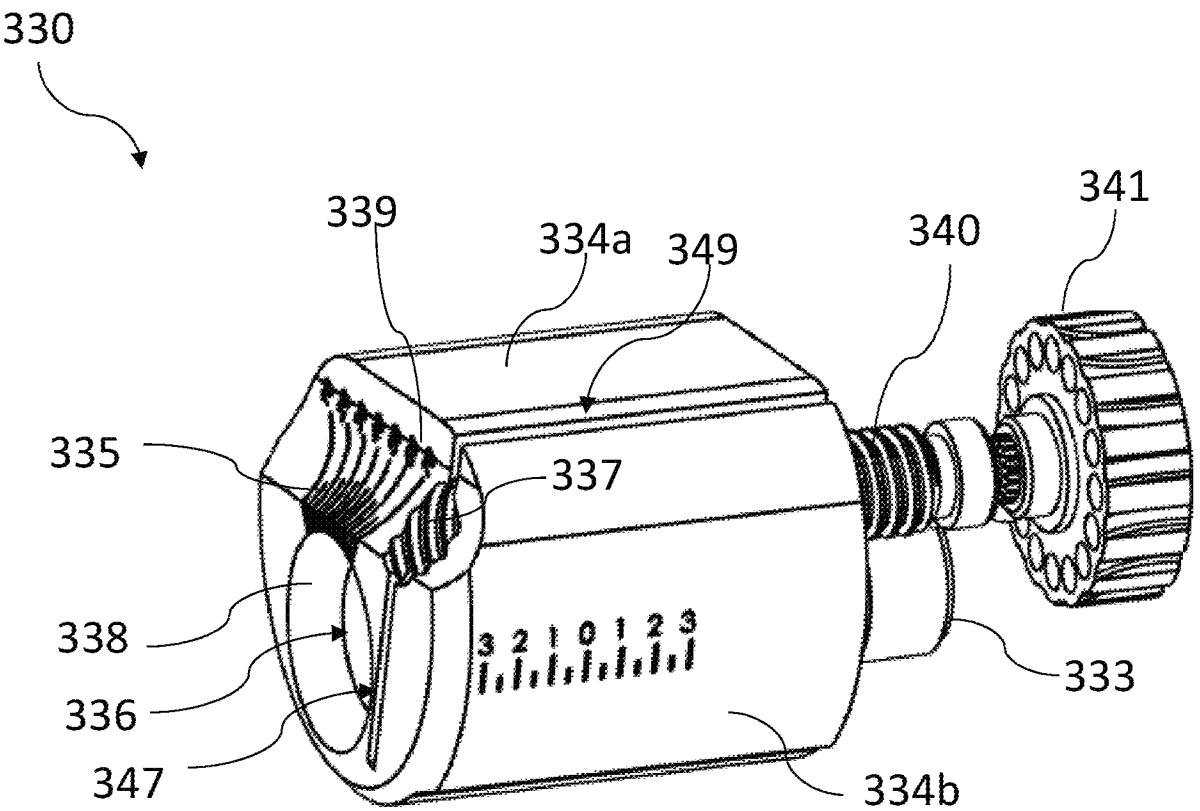
FIG. 13A is an isometric view of the intermediary device of the projectile support device of the archery accessory system of FIG. 1.
Figure 13B:
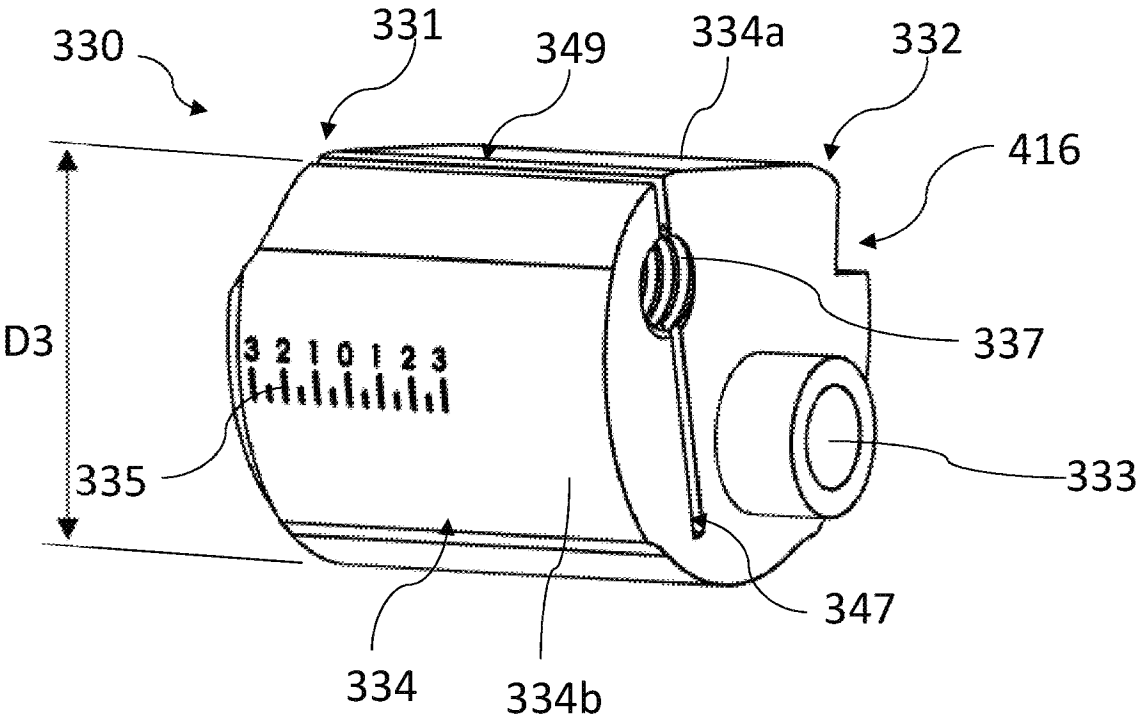
FIG. 13B is another isometric view of the intermediary device of the projectile support device of the archery accessory system of FIG. 1, illustrating the compression cavities.

As illustrated in FIGS. 13A-13B, the projectile support device 300 includes a barrel or an intermediary device 330. The intermediary device 330 is configured to be at least partially positioned within the support cavity 308 (FIG. 10). As shown in FIGS. 8 and 13A-B, the intermediary device 330 includes a first end 331, an opposing second end 332, and an exterior surface or outer surface 334 configured to mate with the first inner surface 312 of the support 310. The outer surface 334 defines an intermediary device cavity 336 including a securing shoulder 338 positioned towards the first end 331 of the intermediary device cavity 336. The outer surface 334 may define or may include one or more measurement or adjustment markings 335, 339 used for positioning of the intermediary device 330 with respect to one or more other components of the projectile support device 300.

In the embodiment shown, the outer surface 334 defines a step-shaped, angular alignment structure 416 (FIG. 13B). The step-shaped alignment structure 416 mates with the support 310 and causes the intermediary device 330 to maintain a designated angular position when the intermediary device 330 is being slid relative to the support 310, as described below. Depending on the embodiment, the alignment structure 416 can include a slotted, grooved or stepped structure configured to mate with a corresponding structure of the support 310.

The intermediary device 330 defines a second inner surface 337 configured to at least partially receive and engage a threaded lateral driver 340. The second inner surface 337 may define one or more surface features (e.g., threads) configured to mate with and engage one or more complimentary surface features defined on the lateral driver 340. As shown in FIGS. 13A-B, one or more compression slits or compression cavities 347, 349 extend through at least a portion of the second inner surface 337 and separate the outer surface 334 into two or more parts 334*a*, 334*b*. The lateral driver 340 may include a driver knob or driver grasp 341 coupled to one end of the lateral driver 340. The lateral driver 340 is configured to move relative to the intermediary device 330. Rotation of the driver grasp 341 rotates the lateral driver 340, which, in turn, causes the intermediary device 330 to move in a lateral direction along the X axis (FIG. 1). Rotation of the lateral driver 340 in a first direction acts to drive the intermediary device 330 along the first inner surface 312 of the support 310 in a lateral direction and moves the first end 331 of the intermediary device 330 away from the support 310. Rotation of the lateral driver in the opposite or second direction acts to drive the intermediary device 330 along the first inner surface 312 of the support 310 in a lateral direction and moves the first end 331 of the intermediary device 330 towards the support 310.

It should be understood that the engagement of the threads of the lateral driver 340 with the threads of the second inner surface 337 can result in a gap which enables undesirable movement between the lateral driver 340 and the second inner surface 337 after the lateral position of the intermediary device 330 has been set by the lateral driver 340. This undesirable movement, referred to as slop or play, can decrease the accuracy of such setting. This undesirable movement can be increased as the result of imperfections in manufacturing tolerances of the threaded portion of the second inner surface 337 and the complimentary threaded portion of the lateral driver 340. The slop in the threads can lead to inaccuracies, errors and imprecisions during the adjustment, setting and use of the driver grasp 341 and lateral driver 340.

The compression cavities 347, 349 provide an advantage that impedes or prevents this undesired movement. Referring to FIGS. 10-13A, the screwing of the securing member 320 into the support 310 causes the widths of compression cavities 347, 349 to decrease. As a result, the second inner surface 337 applies a compression force to the lateral driver 340. The compression force immobilizes the lateral driver 340. Consequently, regardless of the gaps between threaded surfaces, there is relatively little or no slop between the second inner surface 337 and the lateral driver 340 after the user sets the lateral position of the intermediary device 330. Eliminating the slop impedes or prevents the driver grasp 341 from rotating after user sets the lateral position, thereby locking the lateral position of the intermediary device 330 in relation to the support 310 in a lateral direction along the X axis (FIG. 1).

As shown in FIGS. 13A-13B, the intermediary device 330 further has a third inner surface 333 defining an angle adjustment channel to at least partially receive an angle setter 361 (FIG. 8). As shown, the third inner surface 333 is smooth, however in other embodiments, the third inner surface 333 may define one or more surface features configured to mate with and engage at least a portion of the angle setter 361. As shown in FIG. 13B, the intermediary device 330 includes an outer, third diameter D3. In an embodiment, diameter D3 is larger than diameter D1 (FIG. 10) of the support cavity 308. In another other embodiment, diameter D3 is larger than the first and second diameters D1, D2 (FIG. 10) of the support cavity 308. Because of the enlarge size of diameter D3, the insertion of the intermediary device 330 into the support cavity 308 causes the first inner surface 312 of the support 310 to interfere with the intermediary device 330, which, in turn, produces a friction fit between the support 310 and intermediary device 330. This is associated with a first level of engagement or securement between the support 310 and intermediary device 330.

As illustrated in FIGS. 8, 9, 14, 14A and 15, the projectile support device 300 includes an archery device holder 360. The archery device holder 360 is configured to support or hold an archery device 390. In the embodiment shown, the archery device 390 is an arrow launcher or projectile support configured to support projectile 11. Archery device 390 is pivotal relative to the mount device 200 during shooting action. In other embodiments not shown, different types and shapes of archery device holders are configured to hold a variety of different types of archery devices including, but not limited to, a projectile support device, an arrow rest device, an arrow holder device, a sight device, a flashlight device, or a bow stabilizer device.

Figure 15:
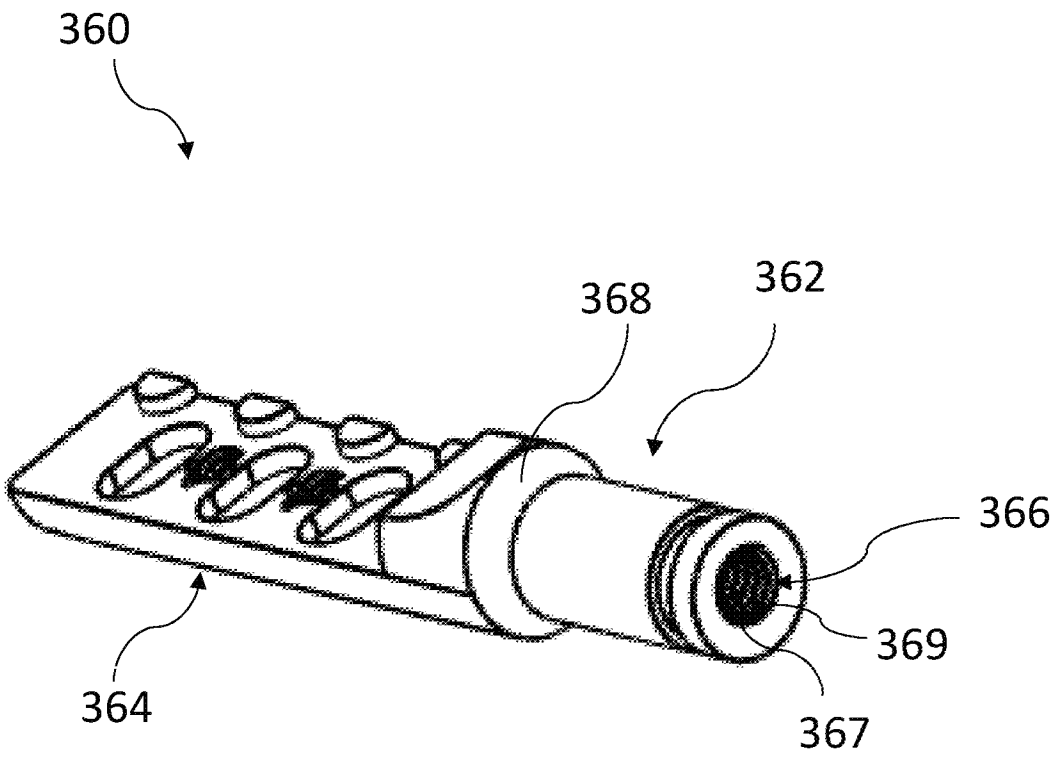
FIG. 15 is another isometric view of the archery device holder of the projectile support device of the archery accessory system of FIG. 1.

The archery device holder 360 includes a first holder section 362 and a second holder section 364. The first holder section 362 defines a holder channel 366 defined by a holder channel surface 367. As shown in FIG. 15, the holder channel surface 367 defines one or more surface features 369 (e.g., threads) configured to engage and mate with one or more complimentary surface features 363 defined on the angle setter 361 (FIG. 8). The surface features and complimentary surface features defined or positioned on components of the projectile support device 300 may include threads, ridges, grooves, recesses, protrusions, or any other suitable features configured to allow engagement and mating of two components.

Figure 14:
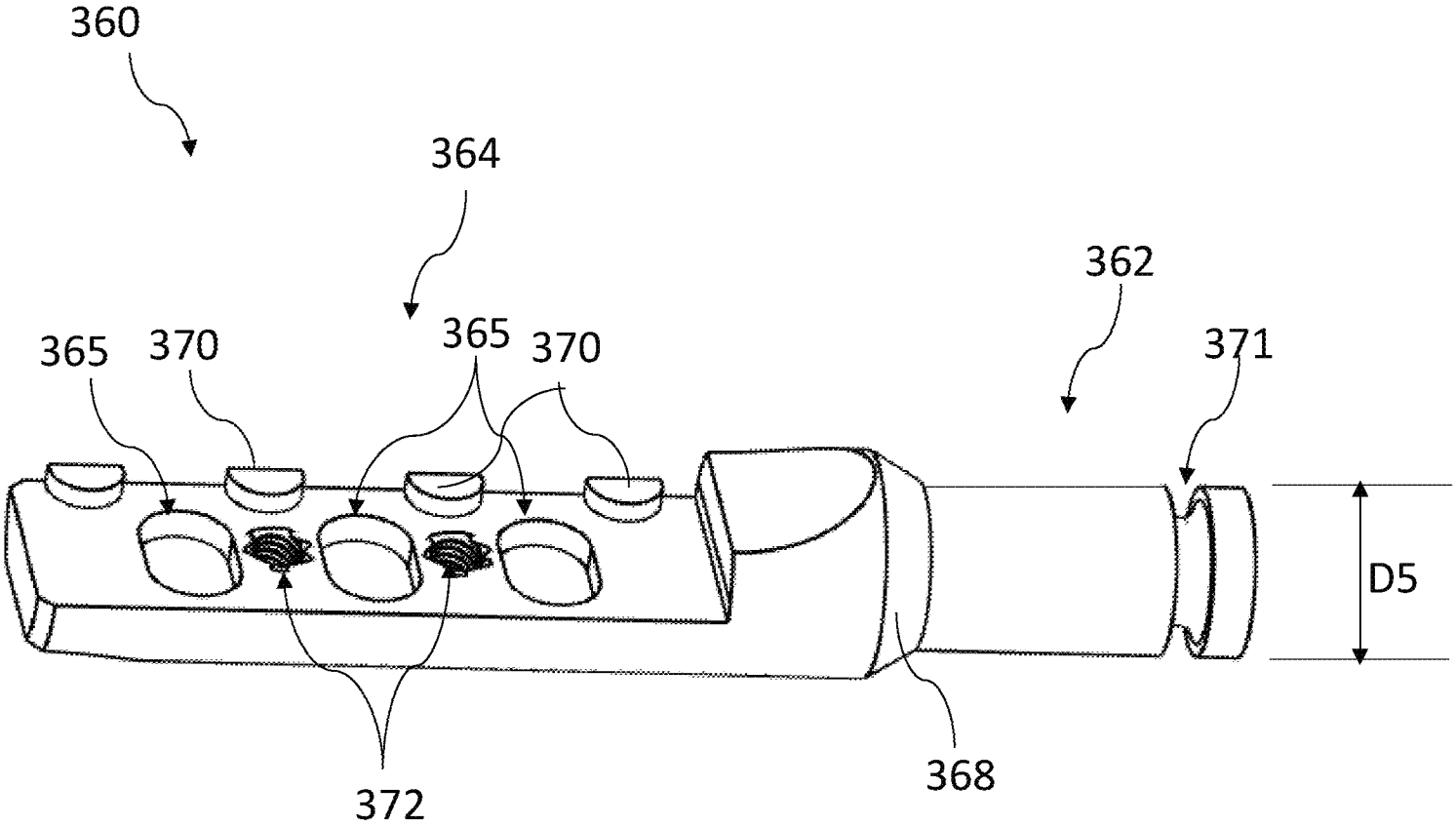
FIG. 14 is an isometric view of the archery device holder of the projectile support device of the archery accessory system of FIG. 1.

As shown in FIG. 14, the first holder section 362 also defines a circular groove 371. In an embodiment not shown, the archery device holder 360 includes a resilient band or ring, such as a rubber O-ring, that fits within the groove and, when seated, has an outer diameter greater than the diameter D5 of the first holder section 362. Such O-ring has a biasing characteristic that increases the frictional fit between the archery device holder 360 and the intermediary device 300.

Figure 14A:
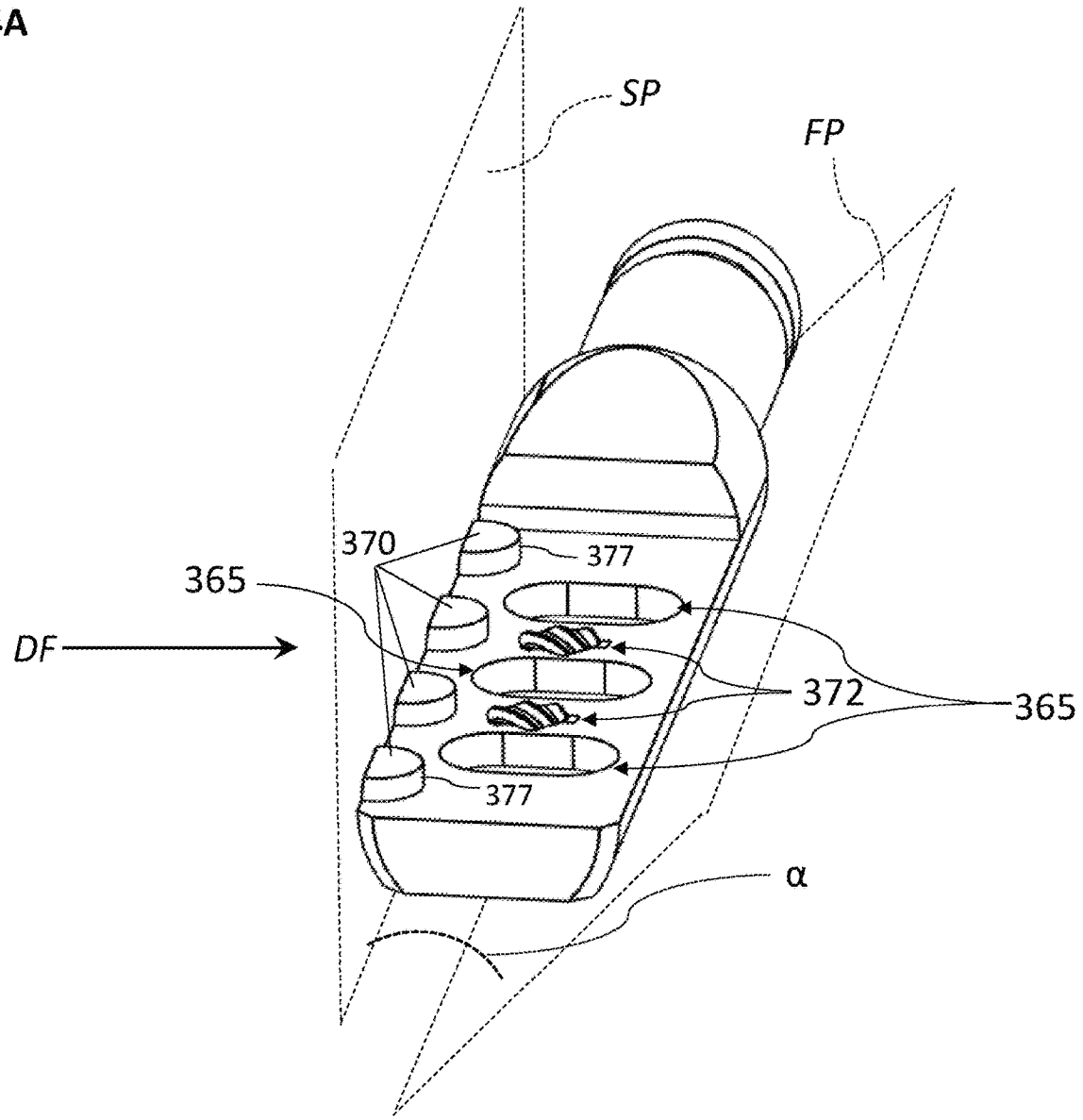
FIG. 14A is another isometric view of the archery device holder of the projectile support device of the archery accessory system of FIG. 1, illustrating the securement plane SP and the fastener plane FP.

As illustrated in FIGS. 14-14A, the second holder section 364 includes a plurality of securement members 370 spaced apart from each other and extending along a securement plane SP. The second holder section 364 further defines a plurality of first securement openings 365 and one or more first fastener channels 372. The one or more first fastener channels 372 extend along a fastener plane FP that intersects the securement plane SP at an angle $\alpha$, as shown in FIG. 14A.

Figure 16:
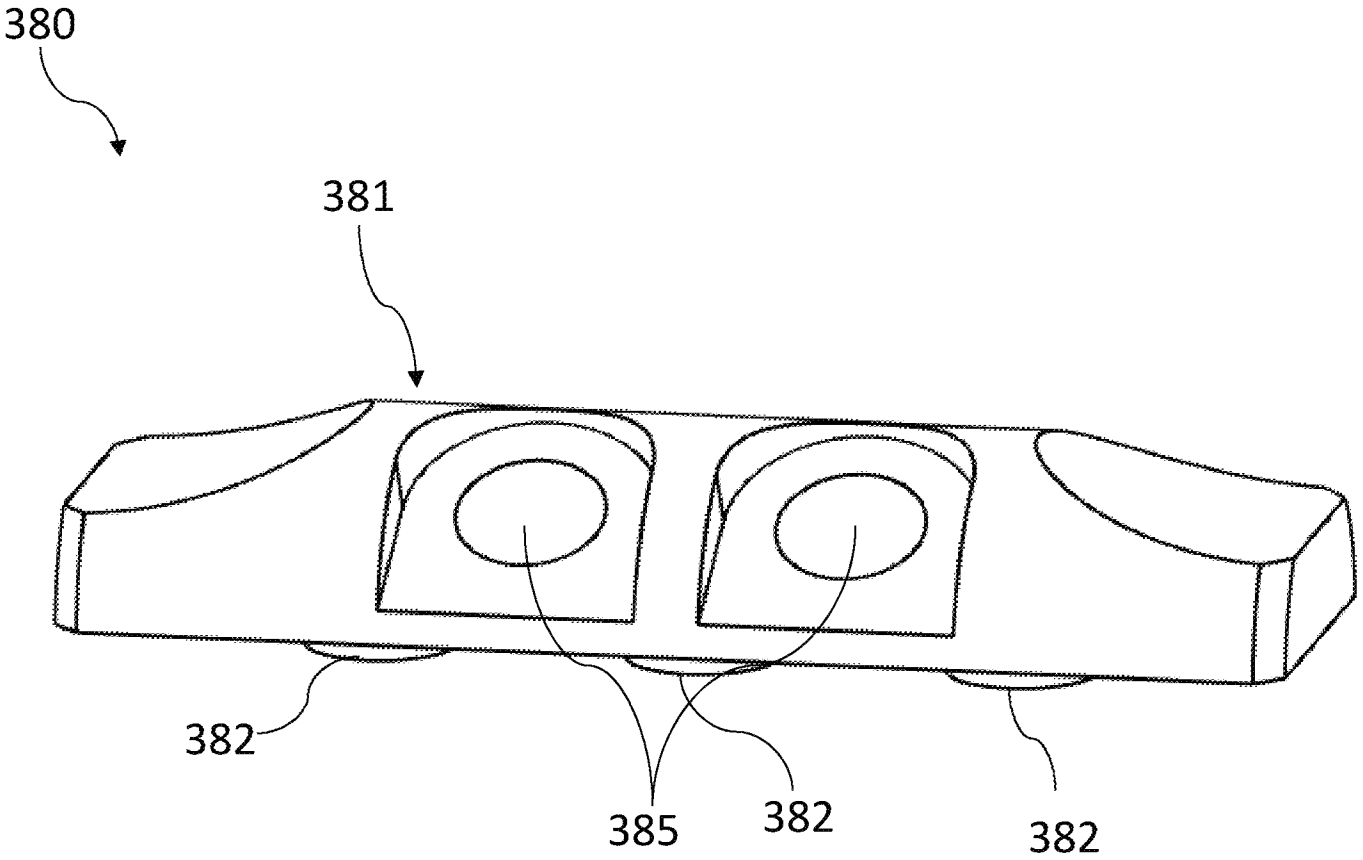
FIG. 16 is a top, isometric view of an embodiment of an accessory retainer of the archery device holder of the projectile support device of the archery accessory system of FIG. 1.
Figure 17:
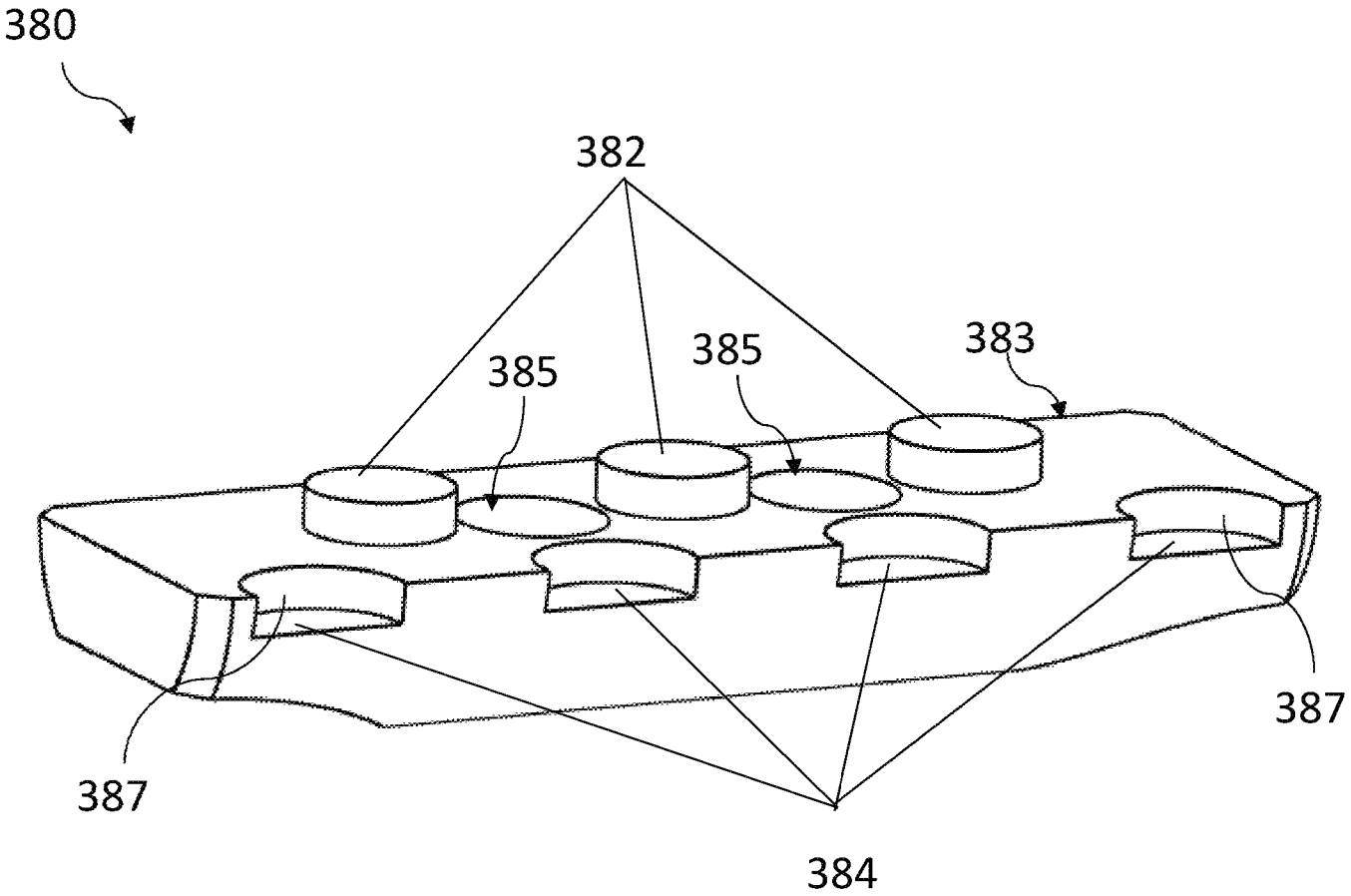
FIG. 17 is a bottom, isometric view of an embodiment of the accessory retainer shown in FIG. 16.

In an embodiment, the angle $\alpha$ is approximately 45°. The plurality of first securement openings 365 are configured to at least partially receive a portion of an accessory fastener or accessory retainer 380, shown in FIG. 16. The first holder section 362 also has a stopper 368 extending to the second holder section 364. The stopper 368 is configured to engage the securing shoulder 338 of the intermediary device 330 to establish a stopping point for the location of the archery device holder 360 relative to the intermediary device cavity 336. The interaction between the stopper 368 and the securing shoulder 338 may further act to define a repeatable lateral insertion position of the archery device holder 360 within the intermediary device cavity 336. In the embodiment shown, the stopper 368 has a male, conical shape that mates with the female, conical shape of the securing shoulder 338 (FIG. 13A). When engaged together, the stopper 368 has a frictional fit with the securing shoulder 338.

As shown in FIGS. 8, 9, 16, and 17, the accessory retainer 380 includes a first side 381 and a second side 383. The second side 383 of the accessory retainer 380 defines a plurality of securing members 382 and engagement elements 384. The accessory retainer 380 further defines one or more second fastener channels 385 arranged to be aligned with the one or more first fastener channels 372 when the accessory retainer 380 is positioned on the second holder section 364 such that the securing members 382 sit within with and are engaged with the plurality of first securement openings 365.

The archery device holder 360 is configured to hold an archery device 390, as shown in the embodiment of FIGS. 8, 9, and 18. In an embodiment, the archery device 390 includes an upper end 391 having a projectile contact portion 394 configured to contact and assist in holding and guiding the projectile 11 (FIG. 1) as the projectile 11 is loaded into the projectile support device 300 in a pre-shoot or aiming position, as shown in FIG. 1. The archery device 390 also holds the projectile 11 during launching of the projectile 11. A lower end 393 of the archery device 390 defines a plurality of securement extensions 396 and defining a plurality of second securement openings 395. As shown, the plurality of securement extensions 396 are spaced apart from each other to define fastener notches 392. In an embodiment, the archery device 390 may define one or more additional openings 399 for the purpose of aerodynamics, weight reduction or additional securement to the archery device holder 360.

Referring to FIGS. 8 and 18, the archery device 390 is configured to be retained on the archery device holder 360 by the accessory retainer 380. The securement extensions 396 are configured to be positioned on or seated within the engagement elements 384. In this position, the plurality of second securement openings 395 are configured to align with the plurality of first securement openings 365 of the archery device holder 360. The fastener notches 392 are configured to partially surround the one or more first fastener channels 372. The accessory retainer 380 is then positioned on the second holder section 364 such that the plurality of securing members 382 traverse the plurality of second securement openings 395 and are received by the plurality of first securement openings 365 of the archery device holder 360. The one or more first fastener channels 372 are aligned with the one or more second fastener channels 385 and are configured to accept a fastener 373 to fasten the accessory retainer 380 to the second holder section 364 of the archery device holder 360 to secure the archery device 390 therebetween. As a result, the archery device 390 is inhibited from moving relative to the archery device holder 360. The interaction of the second holder section 364 of the archery device holder 360 and the accessory retainer 380 with the archery device 390 enables the archer to conveniently remove a damaged or worn archery device 390 (e.g., a projectile support blade) and insert an undamaged archery device 390 at the exact same position without requiring retuning of the archery bow 10.

Referring to FIGS. 14A and 18, during operation of the archery bow 10, there are variable decoupling forces DF acting on the archery device holder 360. The DF forces can be based on the weight of the projectile 11, the movement of the projectile 11, the vibration of the archery bow 10, impact or collisions with environmental elements, and other factors. The DF forces tend to loosen the connection between the archery device holder 360 and the archery device holder 360. The orientation of the securement members 370 and first fastener channels 372 cause a counteractive, securing force that counters such loosening tendency. In particular, when the archery device 390 is sandwiched between the archery device holder 360 and the accessory retainer 380, the securement portions 387 (FIG. 17) of the accessory retainer 380 apply an angled securing force to the member portions 377 (FIG. 14A) of the archery device holder 360. This provides an important improvement by reducing undesired loosening of the archery device 390.

Figure 18A:
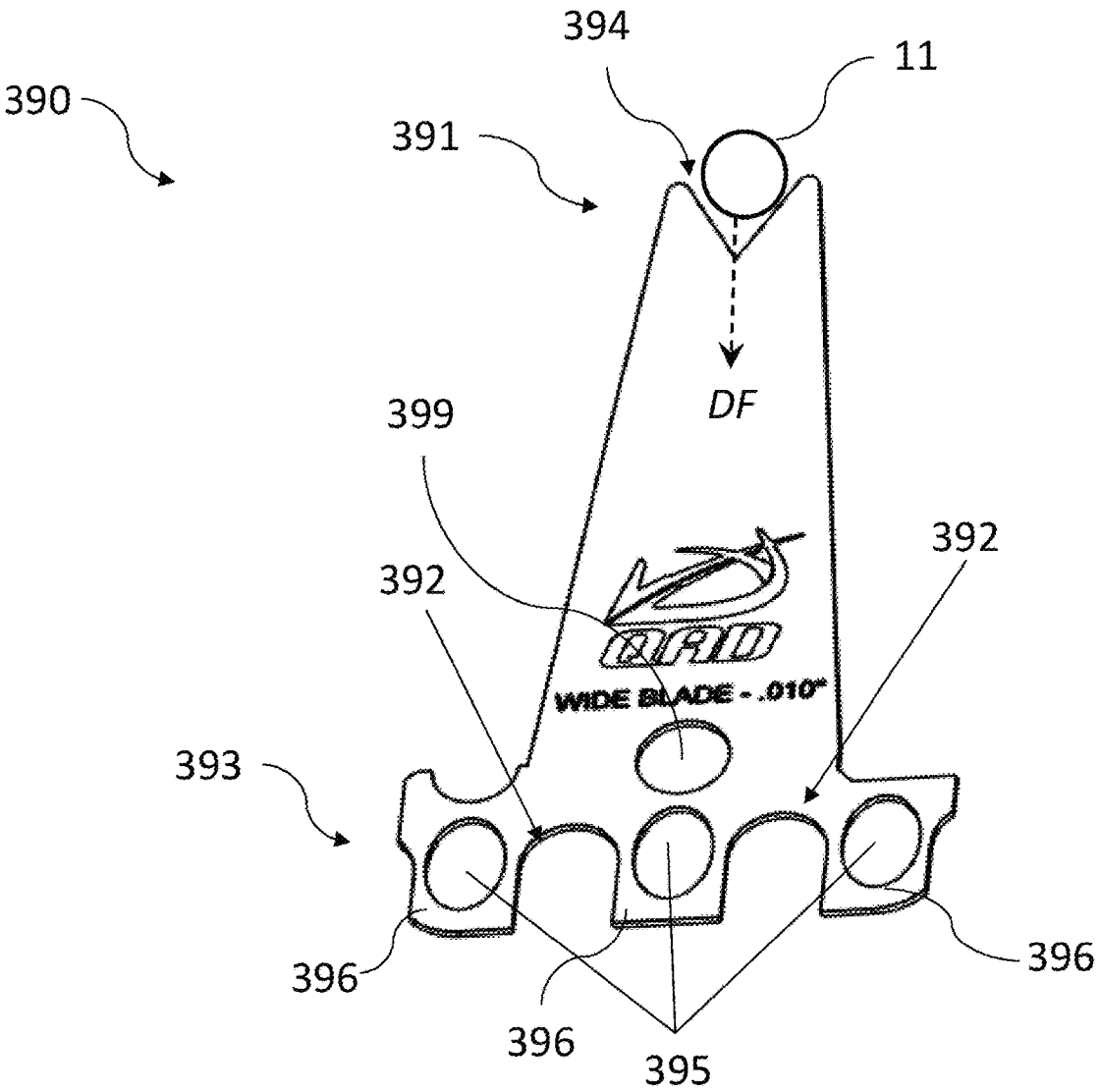
FIG. 18A is a front isometric view of an embodiment of the archery device of the projectile support device of the archery accessory system of FIG. 1.
Figure 18B:
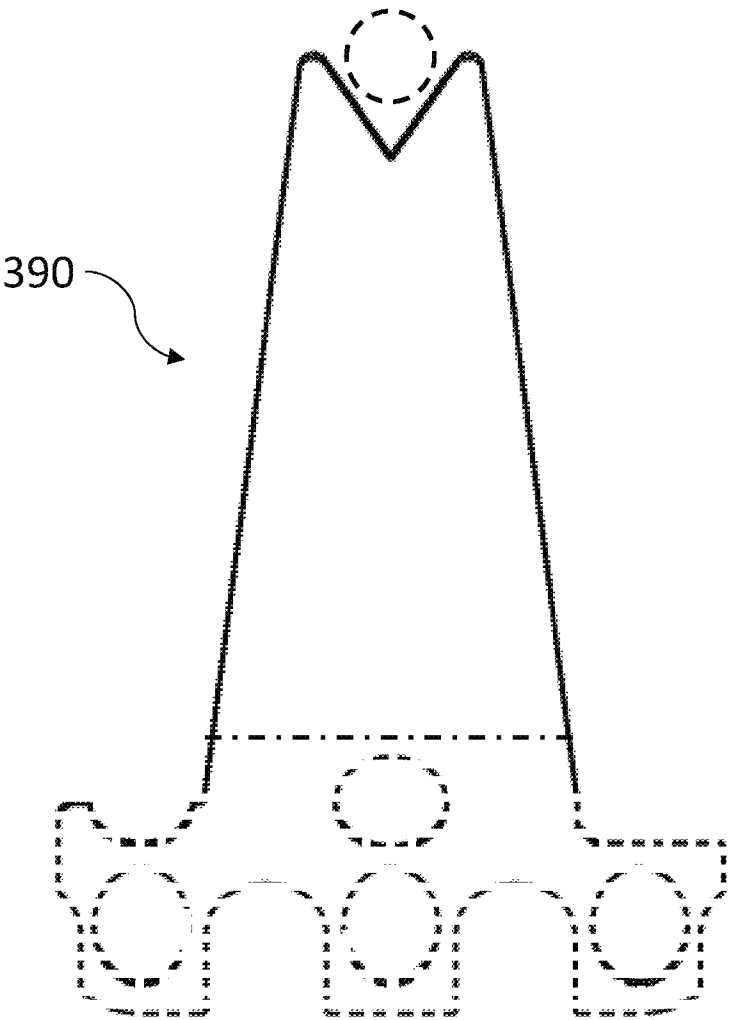
FIG. 18B is a front elevation view of the archery device shown in FIG. 18A.
Figure 18C:
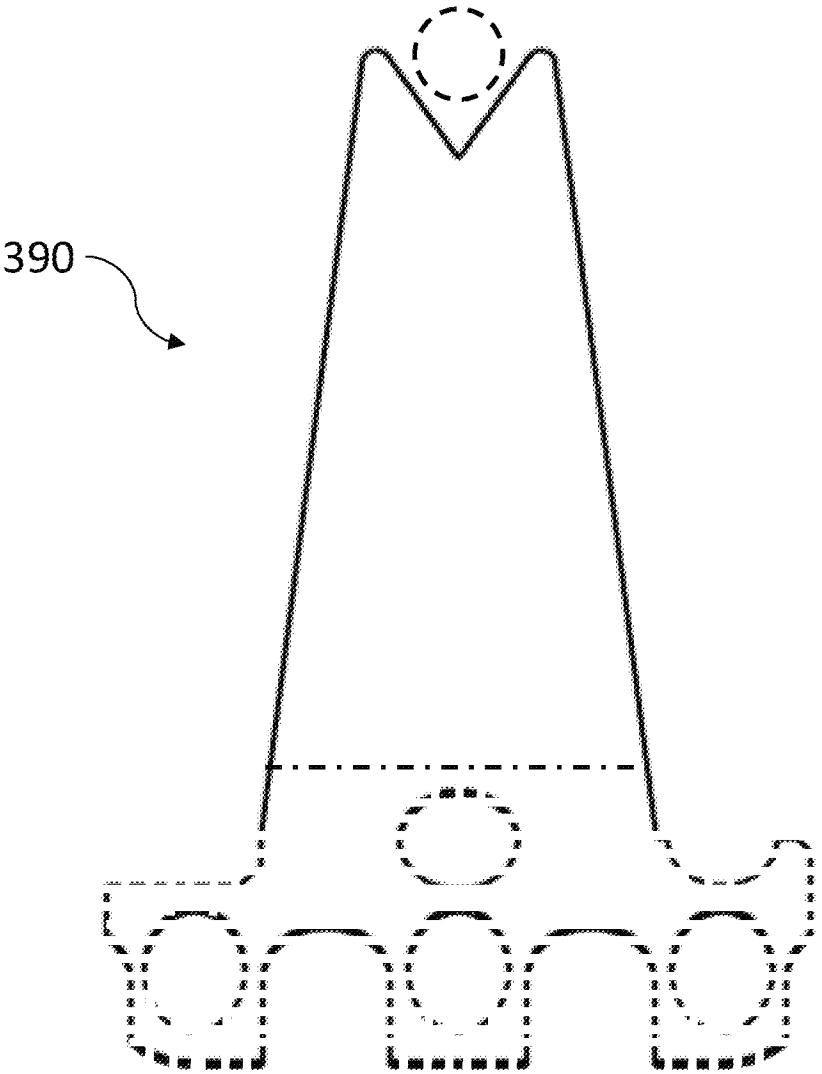
FIG. 18C is a rear elevation view of the archery device shown in FIG. 18A.
Figure 18D:
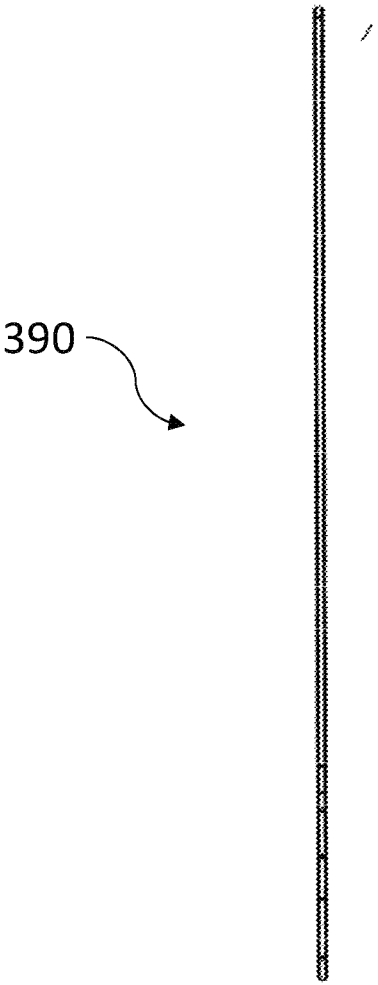
FIG. 18D is a side elevation view of the archery device shown in FIG. 18A.
Figure 18E:
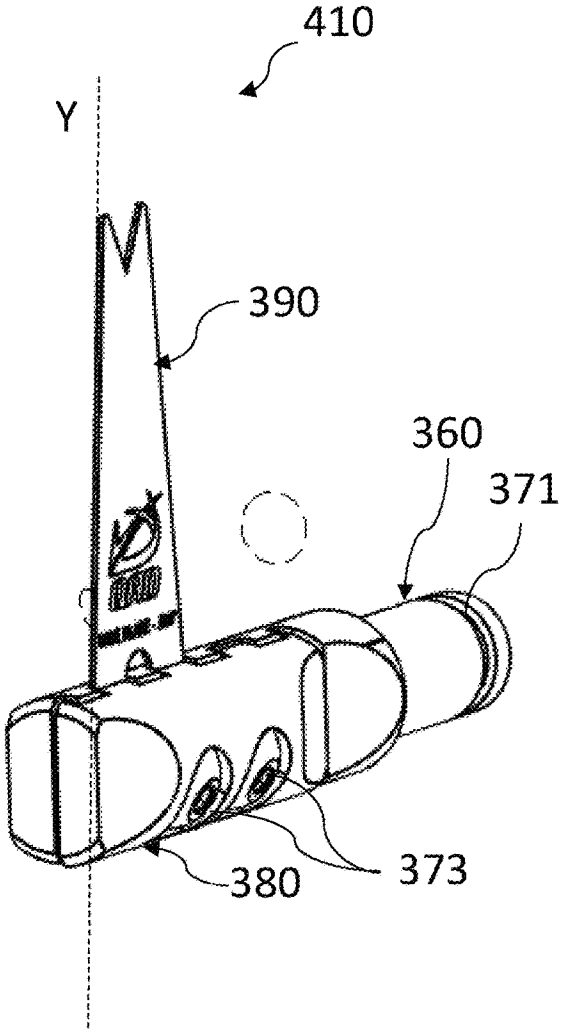
FIG. 18E is a rear, isometric view of the archery device and archery device holder of the projectile support device of the archery accessory system of FIG. 1, illustrating the archery device in a first aiming position.
Figure 18F:
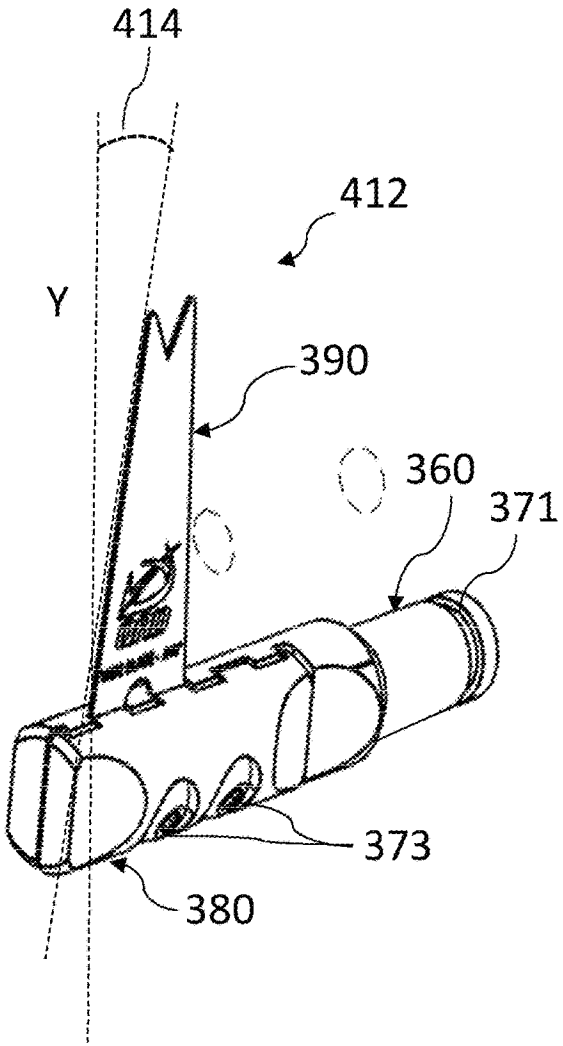
FIG. 18F is a rear, isometric view of the archery device and archery device holder of the projectile support device of the archery accessory system of FIG. 1, illustrating the archery device in a second aiming position.

Referring to FIGS. 18D-18E, the projectile support device 300 described above enables an adjustment of an angular position or pitch for tuning the angular position of the archery device holder 360 relative to the archery bow 10. In the example shown in FIGS. 18D-18E, the projectile support device 300 enables a user to rotate and adjust the archery device holder 360 relative to the archery bow 10 to establish a desired aiming position, such as aiming position 410 or aiming position 412. In aiming position 410, the archery device 390 has no angle relative to the Y axis (FIG. 1). In the aiming position 412, the archery device 390 extends at a desired angle 414 relative to the Y axis.

As described below, the user can change from aiming position 410 to aiming position 412 without losing the previously-established lateral position of the archery device holder 360 along the X axis (FIG. 1) relative to the archery bow 10. According to one embodiment, the user or installer can install and use the archery accessory system 100 according to the steps described in the following method:

(a) The user installs the archery device 390 onto the archery device holder 360, as described above.

(b) The user inserts the archery device holder 360 into the intermediary device 330.

(c) The user inserts the intermediary device 330 into the support 310.

(d) The user inserts and rotates the angle setter 361 into the support 310, intermediary device 330 and archery device holder 360 without fully tightening the angle setter 361.

(e) The user manually rotates the archery device holder 360 until reaching a desired angular position, such as aiming position 414 (FIG. 18F), which corresponds to a desired angular position setting.

(f) The user fully tightens the angle setter 361 to fixedly establish such angular position.

(g) The user inserts the lateral driver 340 into the support 310 and rotates the driver grasp 341. Depending on the rotation direction, this causes the archery device holder 360 to translate or move laterally, right or left, along the X axis (FIG. 1) until the user reaches the desired lateral position of the archery device holder 360 relative to the archery bow 10.

(h) When reaching such desired lateral position, the user inserts and fully tightens the securing member 320 (FIG. 12), which compresses the support 310 onto the intermediary device 330. This establishes a repeatable lateral stopping point or lateral position setting for the archery device holder 360. In this position, the stopper 368 is engaged with the securing shoulder 338, which enables a predictable and repeatable lateral position of the archery device holder 360 (along the X axis) within the intermediary device cavity 336.

(i) To change or re-adjust the angular position, the user partially unscrews or loosens the angle setter 361. This enables the archery device holder 360 to move relative to the intermediary device 330 such that the user can rotate the archery device holder 360 with respect to the intermediary device 330 to adjust an angle δ (FIG. 4) of the archery device 390 relative to the Y plane (FIG. 1). Once the desired angular position is reached, the user rotates and tightens the angle setter 361 to bring the stopper 368 into contact with the securing shoulder 338. This secures the archery device holder 360 within the intermediary device cavity 336. Furthermore, this returns the archery device holder 360 to the same lateral position setting established above. The re-engagement of the stopper 368 with the securing shoulder 338 enables a predictable and repeatable lateral positioning of the archery device holder 360 (along the X axis) within the intermediary device cavity 336. Accordingly, the angular adjustment is accomplished without affecting the lateral position of the archery device holder 360 once the user re-engages the stopper 368 with the securing shoulder 338.

(j) To change or re-adjust the archery device holder 360 in a lateral direction along the X axis (FIG. 1), the user unscrews the securing member 320 of the support 310 to allow expansion of the support cavity 308 from D2 to D1 (FIG. 10). The expansion of the support cavity 308 allows the intermediary device 330 (coupled to the archery device holder 360) to be slid in a lateral direction, along the X axis within the support cavity 308 of the support 310.

(k) To perform the sliding, the user rotates the lateral driver 340 via manipulation of the driver grasp 341. During the sliding, the alignment structure 416 (FIG. 13A) prevents or inhibits the intermediary device 330 from rotating relative to the support 310. While the intermediary device 330 is sliding, the archery device holder 360 is held in place and inhibited from moving relative to the intermediary device 330. Therefore, the user can re-adjust the lateral position of the archery device holder 360 independent of, and without affecting, the angular position of the archery device holder 360.

(l) The user re-fixes the lateral position by tightening the securing member 320, which constricts the support cavity 308 around the intermediary device 330 to exert a compressive force against the intermediary device 330 in a radial direction to inhibit movement of the intermediary device 330 relative to the support 310. As described above, the intermediary device 330 includes one or more compression cavities that are configured to enable the constriction of the intermediary device cavity 336 in response to the compressive force exerted by the support 310. Such constriction further secures the archery device holder 360 within the intermediary device cavity 336.

In an embodiment, the biasing member (e.g., O-ring), seated in the circular groove 371 of the archery device holder 360, maintains the lateral position of the archery device holder 360 when the user adjusts the angular position of the archery device holder 360 during an adjustment mode. For example, such biasing member frictionally engages the intermediary device 330, and during such engagement, the biasing member enables the archery device holder 360 to rotate within the intermediary device 330 without sliding or translating relative to the intermediary device 330. Accordingly, during such rotation, the stopper 368 remains in contact with, and engaged with, the securing shoulder 338.

In another embodiment, when the user adjusts the angular position of the archery device holder 360, the stopper 368 slightly separates from the securing shoulder 338, resulting in a relatively small gap between the stopper 368 and the securing shoulder 338. As a result, the archery device holder 360 slides or translates relative to the intermediary device 330 during the angular adjustment mode. When the user completes the angular adjustment, the user pushes the archery device holder 360 toward the intermediary device 330 until the gap is eliminated and the stopper 368 contacts the securing shoulder 338. This completes the transition from the angular adjustment mode to an angular set mode.

It should be appreciated that, depending on the embodiment, the foregoing steps of such method can be performed in any suitable sequence. Such steps do not necessarily have to be performed in the sequence set forth above.

Figure 19:
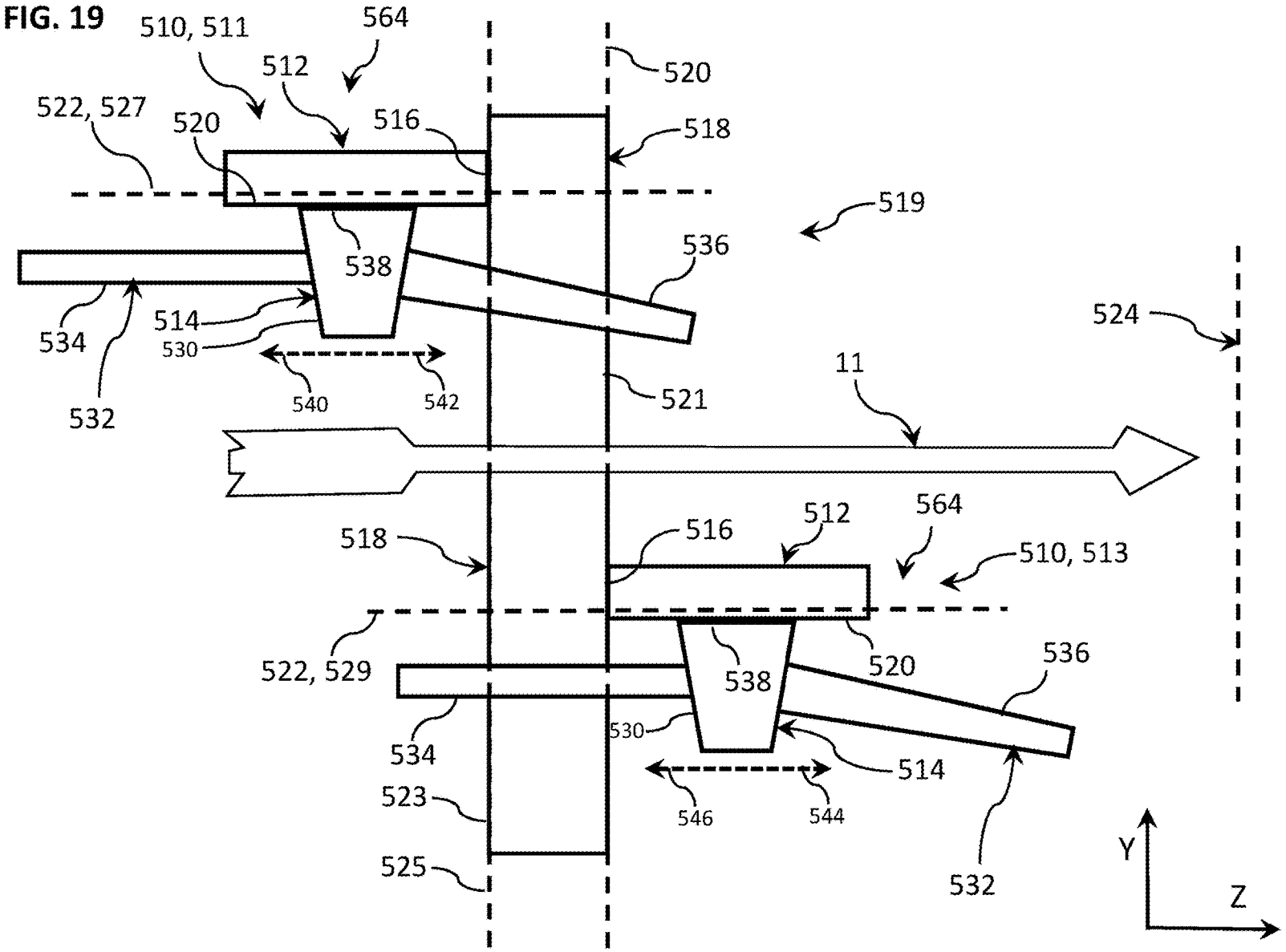
FIG. 19 is a schematic, left side elevation view of an archery weapon having an archery mounting assembly mounted to a rear surface of the archery weapon and another archery mounting assembly mounted to the front surface of the archery weapon.
Figure 20:
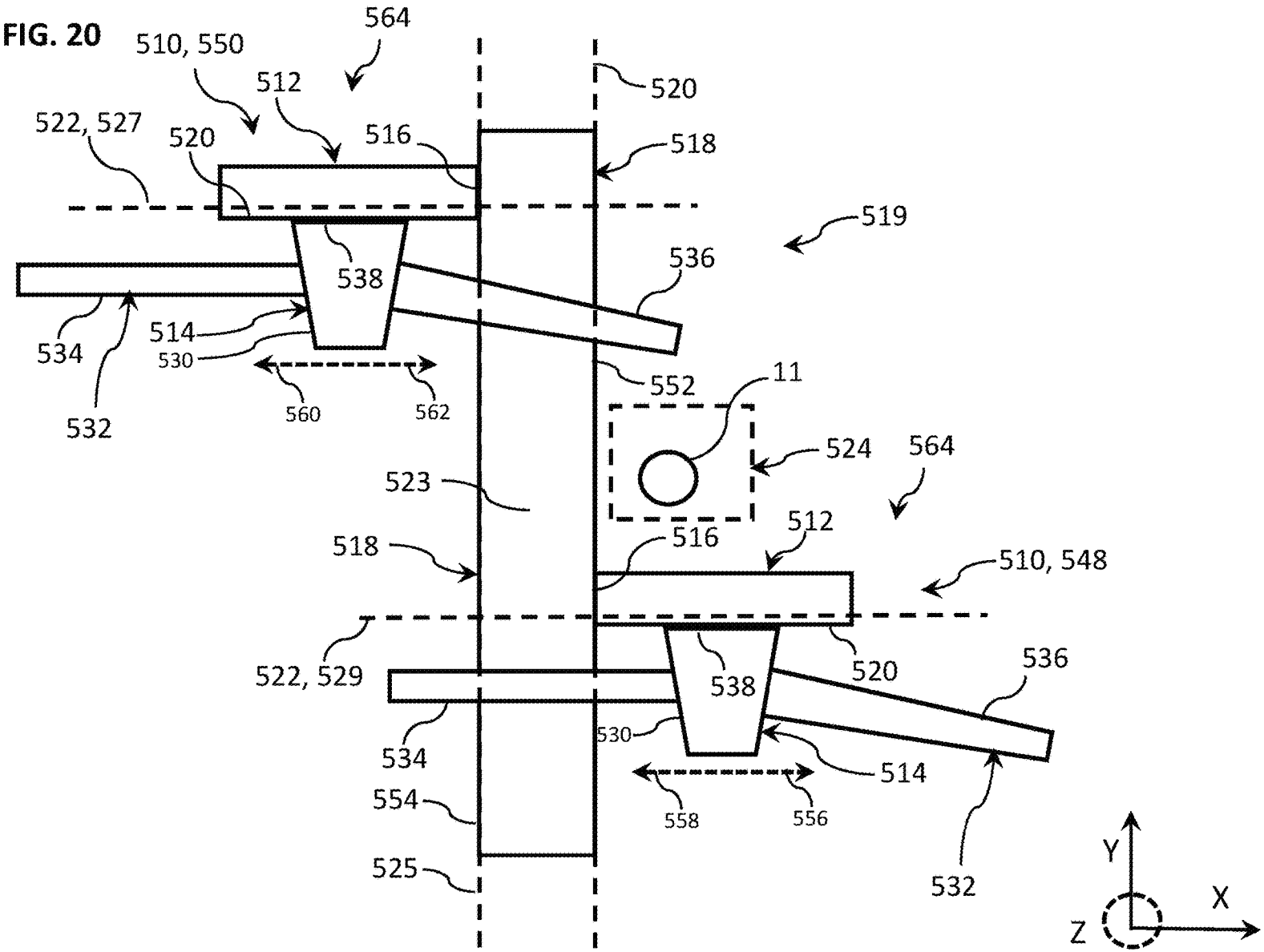
FIG. 20 is a schematic, rear view of the archery weapon of FIG. 18 having an archery mounting assembly mounted to the left side surface of the archery weapon and another archery mounting assembly mounted to the right side surface of the archery weapon.

Referring to FIGS. 19-20, in an embodiment, the archery mounting assembly 510 includes a mount device 512 and an accessory support 514. The mount device 512 includes: (a) a mount portion 516 configured to be engaged with a body 518 of an archery weapon 519; and (b) a first interface 520 that extends at least partially along an adjustment axis 522. The body 518 has a front surface 521 configured to extend at least partially along a vertical plane 520 when the archery weapon 519 is aimed toward a target 524, and the body 518 has a rear surface 523 configured to extend at least partially along a vertical plane 525 when the archery weapon 519 is aimed toward the target 524. The target 524 extends at least partially along each of the vertical planes 520, 525.

The adjustment axis 527 intersects with the vertical plane 525 when the mount portion 516 is engaged with the body 518. The adjustment axis 527 is oriented to extend into the body 518 when the mount portion 516 is engaged with the body 518. The adjustment axis 529 intersects with the vertical plane 520 when the mount portion 516 is engaged with the body 518. The adjustment axis 529 is oriented to extend into the body 518 when the mount portion 516 is engaged with the body 518.

The accessory support 514 includes: (a) a support portion 530 configured to support an accessory 532 having accessory components 534, 536; and (b) a second interface 538 configured to be movably coupled to the first interface 520 of the mount device 512. When the mount portion 516 of archery mounting assembly 511 is engaged with the body 518, the accessory support 514 is configured to be alternately moved, along the adjustment axis 522, in an outbound direction 540 (e.g., rearward) and an inbound direction 542 (e.g., forward), in each case, relative to the body 518. When the mount portion 516 of archery mounting assembly 513 is engaged with the body 518, the accessory support 514 is configured to be alternately moved, along the adjustment axis 522, in an outbound direction 544 (e.g., forward) and an inbound direction 546 (e.g., rearward), in each case, relative to the body 518.

In an embodiment, the first interface 520 of the mount device 512 has an elongated shape, extension or dimension that causes the mount device 512 to extend outward from the body 518 of the archery weapon 519. Because of this dimension, the first interface 520 provides support for the traveling of the accessory support 514 relative to the mount device 512. In particular, the relatively long first interface 520 enables the accessory support 514 to travel a desired distance away from the body 518 of the archery weapon 519.

In the embodiments shown in FIG. 19, the archery mounting assembly 511 is mounted to the rear surface 523 of the body 518, and the archery mounting assembly 513 is mounted to the front surface 521 of the body 518. In other embodiments, described below, archery mount assemblies 510 are mounted to the right and left side surfaces 552, 554, shown in FIG. 20.

In the embodiments illustrated in FIG. 20, archery mounting assemblies 548, 550 each have the same structure, elements and functionality as archery mounting assembly 510. Archery mounting assembly 548 is mounted to the right side surface 552 of the body 518, and archery mounting assembly 550 is mounted to the left side surface 554 of the body 518. When the mount portion 516 of archery mounting assembly 548 is engaged with the body 518, the accessory support 514 is configured to be alternately moved, along the adjustment axis 522, in an outbound direction 556 (e.g., rightward) and an inbound direction 558 (e.g., leftward), in each case, relative to the body 518. When the mount portion 516 of archery mounting assembly 550 is engaged with the body 518, the accessory support 514 is configured to be alternately moved, along the adjustment axis 522, in an outbound direction 560 (e.g., leftward) and an inbound direction 562 (e.g., rightward), in each case, relative to the body 518.

In an embodiment, the mount device 512 of archery mounting assembly 510 includes one or more clamps and the other elements, structures and functionality of mount device 200, described above. A user can clamp the mount device 512 onto the body 518 to mount the mount device 512 to the body 518. In another embodiment, the mount device 512 defines a coupler opening or fastener opening configured to receive a coupler or fastener. A user can insert a coupler or fastener through such opening and into a threaded hole of the body 518 to mount the mount device 512 to the body 518.

In an embodiment, each of the first and second interfaces 520, 538 includes either a structure defining a slot or a notch configured to fit within such slot. In this way, the first and second interfaces 520, 538 movably mate with each other in a slot-and-notch arrangement. In another embodiment, at least one of the first and second interfaces 520, 538 includes a gear element, and the archery mounting assembly 510 has at least one position control device operatively coupled to the gear element, for example, through a rack-and-pinion arrangement. A user can move the second interface 538 relative to the first interface 520 by rotating or operating such position control device. In another embodiment, the archery mounting assembly 510 includes at least one position locking device operatively coupled to at least one of the first and second interfaces 520, 538.

The support portion 530, in an embodiment, includes an accessory holder. In an embodiment, an accessory system 564, shown in FIGS. 19-20, includes the archery mounting assembly 510. The accessory 532 of the archery accessory system 564 includes one or more of the following: (a) an arrow rest device; (b) a bow sight device; (c) an arrow quiver device; (d) a stabilizer device configure to dampen or absorb vibrations; (e) a scope device configured to aid in aiming at a target; (f) a light source device configured to generate visible light; (g) a sensor device configured to detect or sense motion, thermal energy, signs of life or activity, including, but not limited to, a thermal sensor; and (h) an energy generator configured to generate magnetic radiation, electricity, invisible light, sound or other forms of energy.

Figure 21:
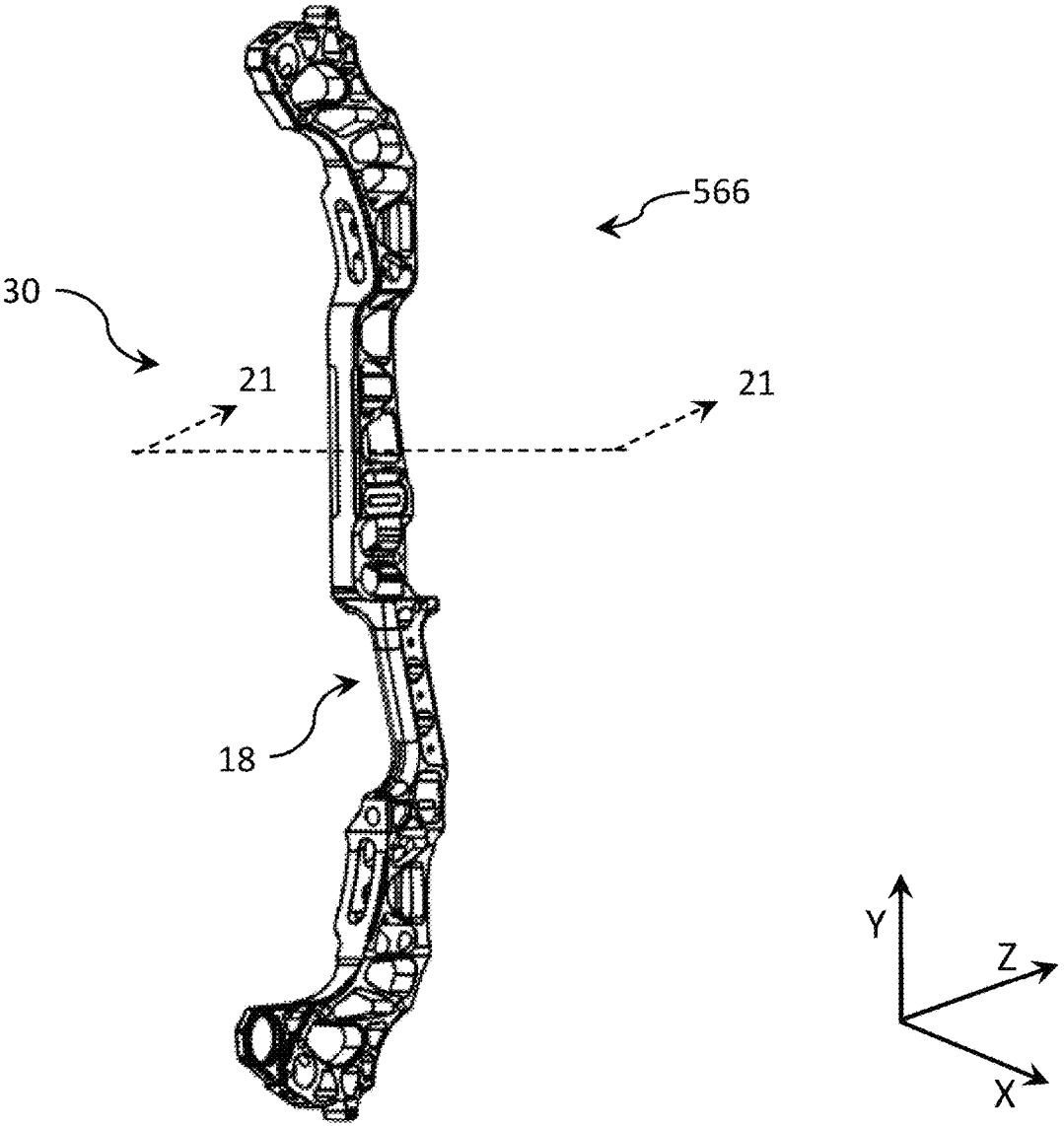
FIG. 21 is a rear, isometric view of an embodiment of a first bow riser.
Figure 22:
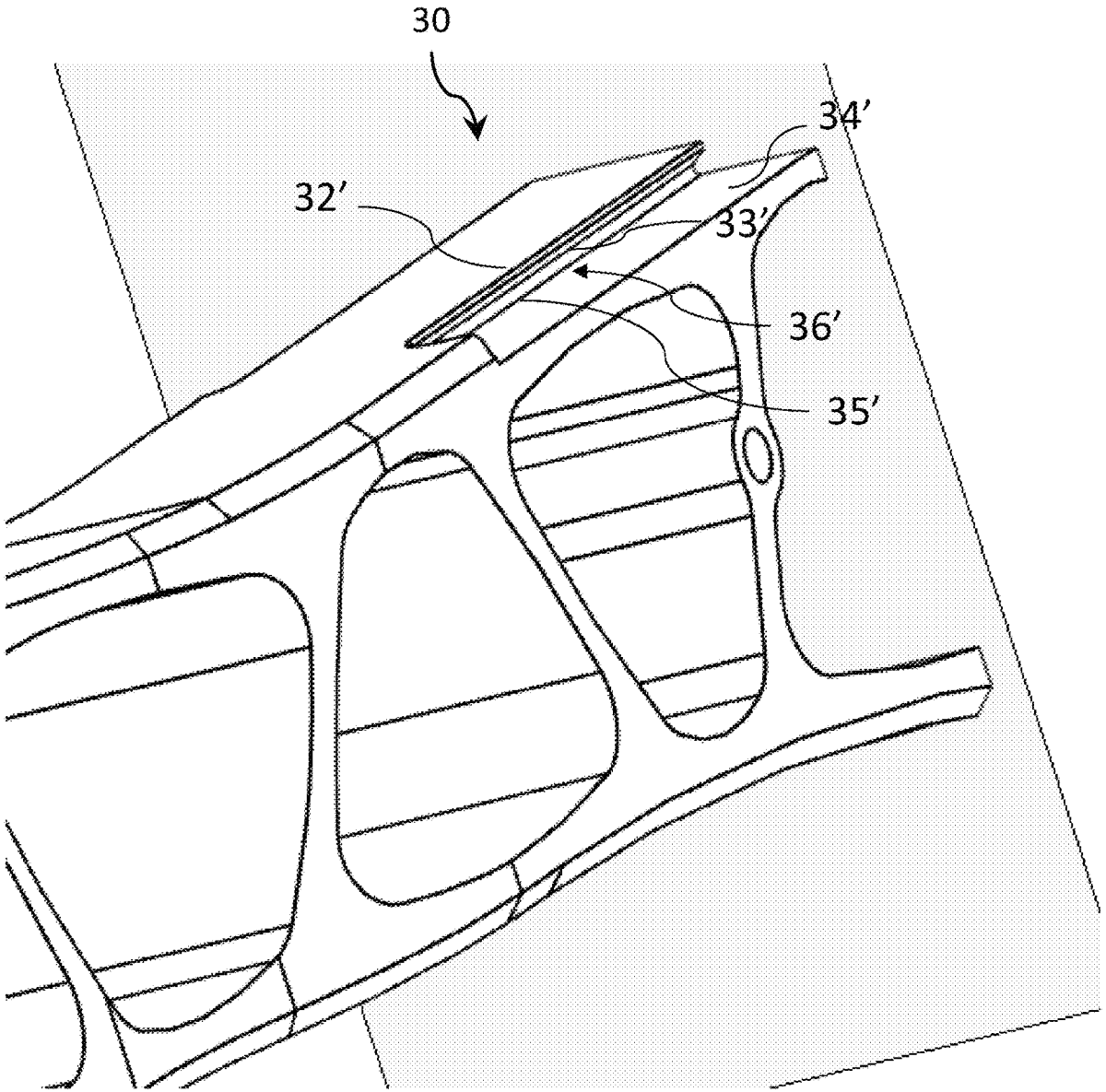
FIG. 22 is a cross-sectional view of the first bow riser of FIG. 21, taken substantially along lines 21-21 of FIG. 21, illustrating a plurality of slots defined by a left portion of the first bow riser.
Figure 23:
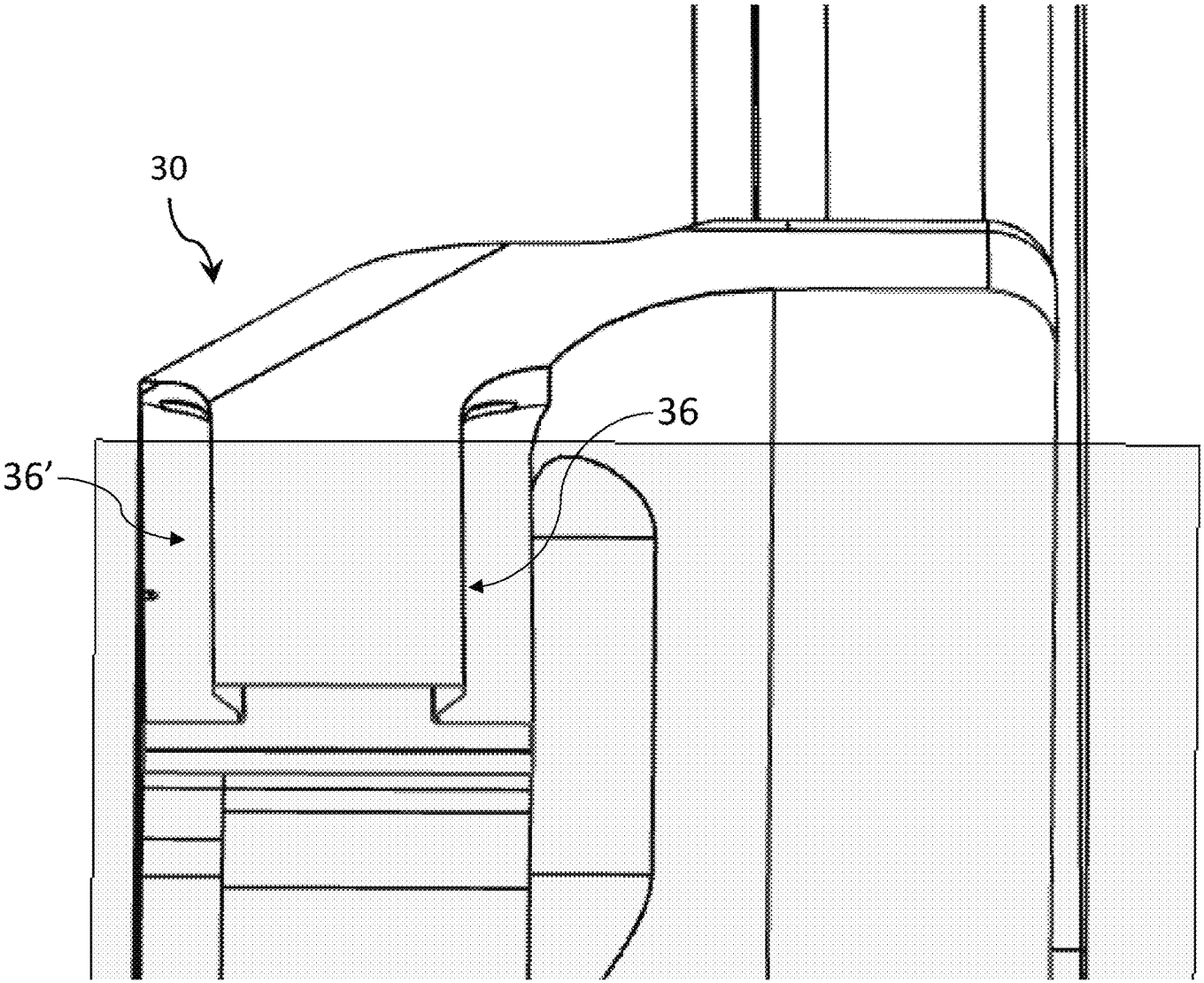
FIG. 23 is a cross-sectional view of the first bow riser of FIG. 21, taken substantially along lines 21-21 of FIG. 21, illustrating a plurality of right and left slots defined by the first bow riser.

Referring to FIGS. 21-23, in an embodiment, the body 518 includes the bow riser 566. Bow riser 566 includes the body mounting portion 30 and handle 18 described above. The body mounting portion 30 includes the left mount surfaces 32', 33', 34', 35'. The left mount surfaces 32', 33', 34', 35' define the left cavity or left slot 36', and the body mounting portion 30 also defines the right slot 36, as described above. The body mounting portion 30 causes the body 518 to be matingly compatible with the archery mounting assembly 510. In particular, the slots 36' and 36 enable the body 518 to be securely and adjustably clamped by the archery mounting assembly 510.

Figure 24:
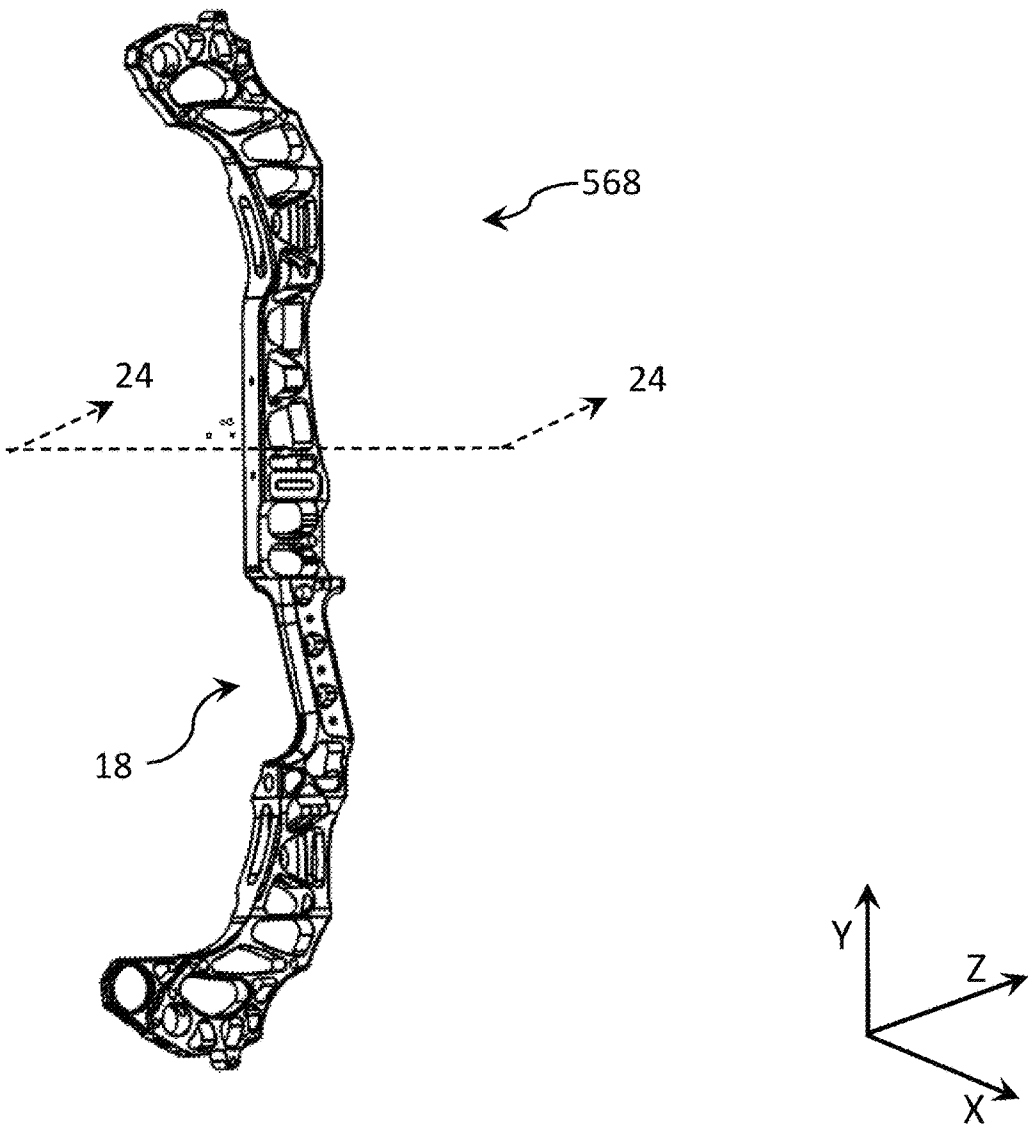
FIG. 24 is a rear, isometric view of an embodiment of a second bow riser.
Figure 25:
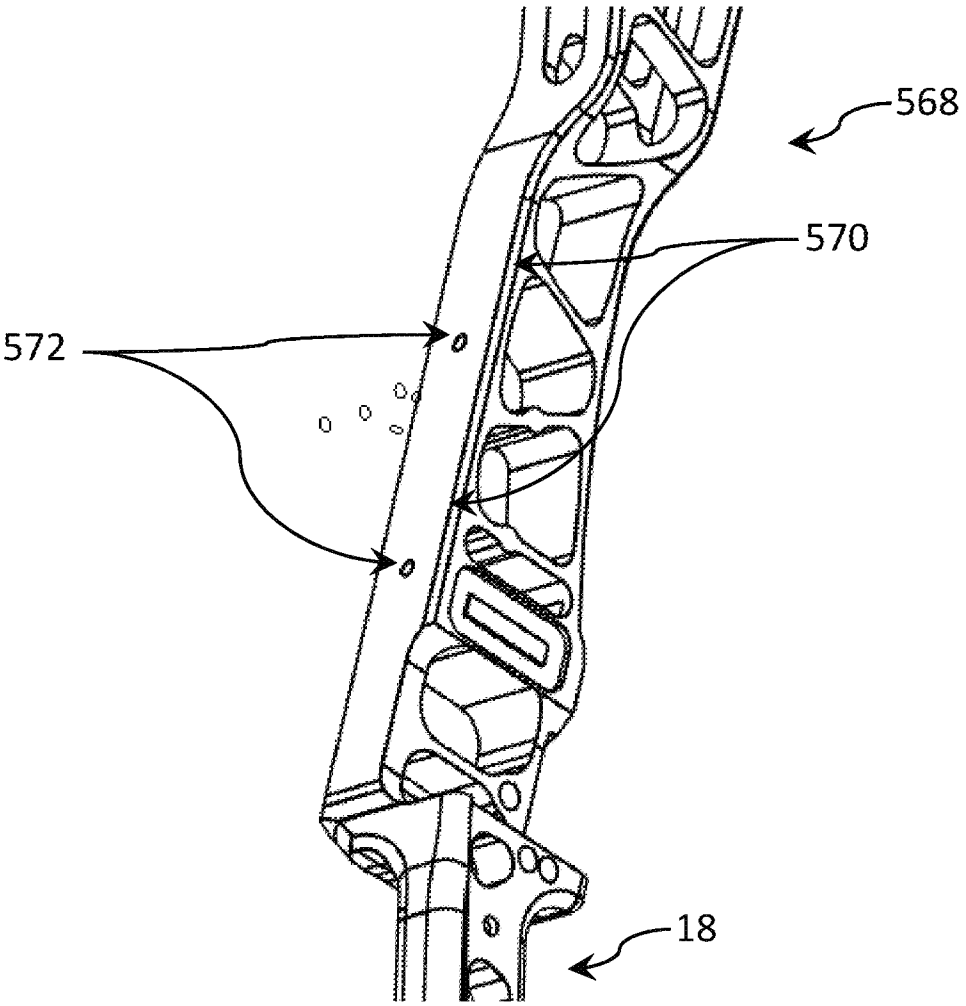
FIG. 25 is an enlarged, rear, isometric view of a portion of the second bow riser, illustrating the adapter holes in the second bow riser.
Figure 26:
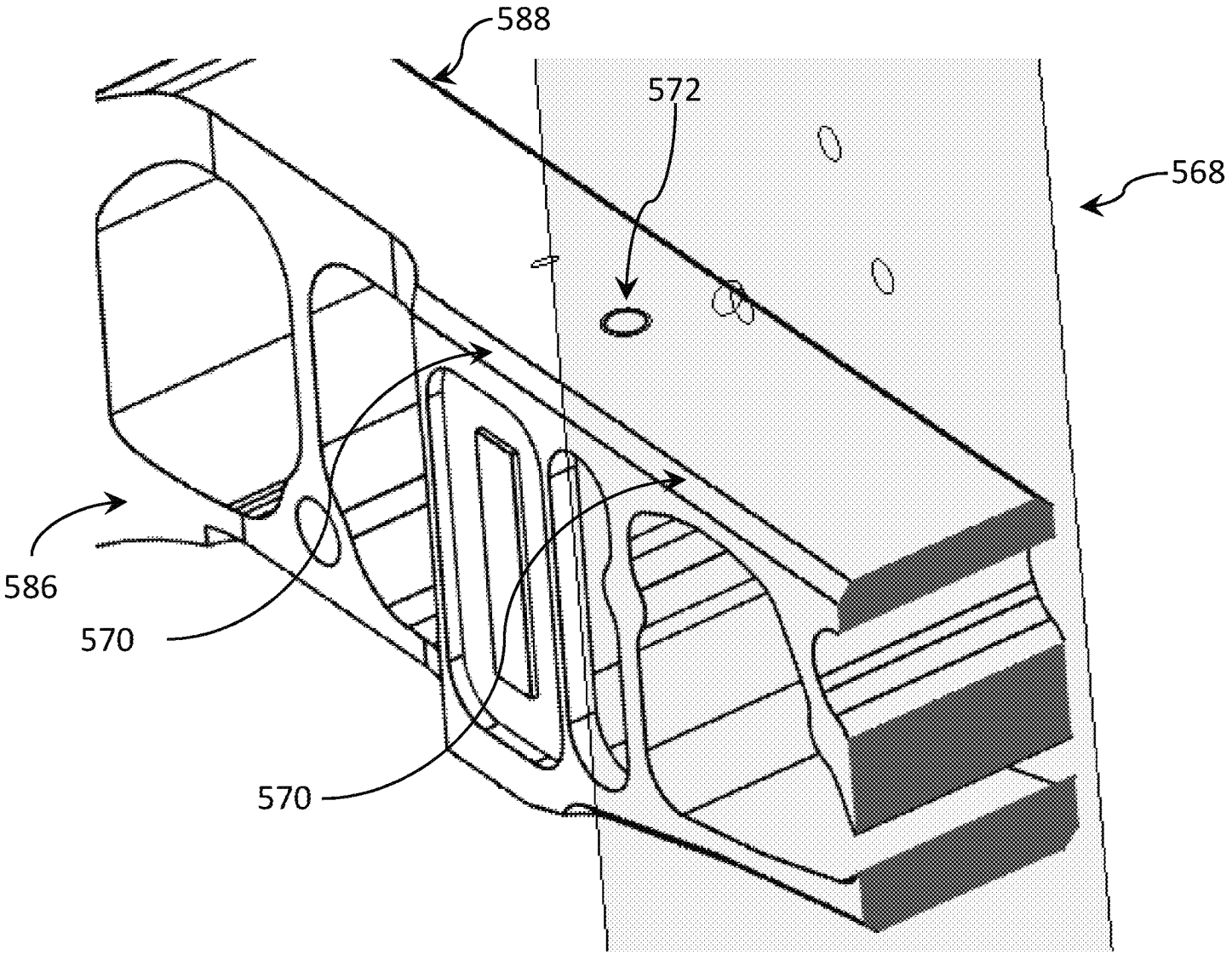
FIG. 26 is a cross-sectional view of the second bow riser of FIG. 24, taken substantially along lines 24-24 of FIG. 24.
Figure 27:
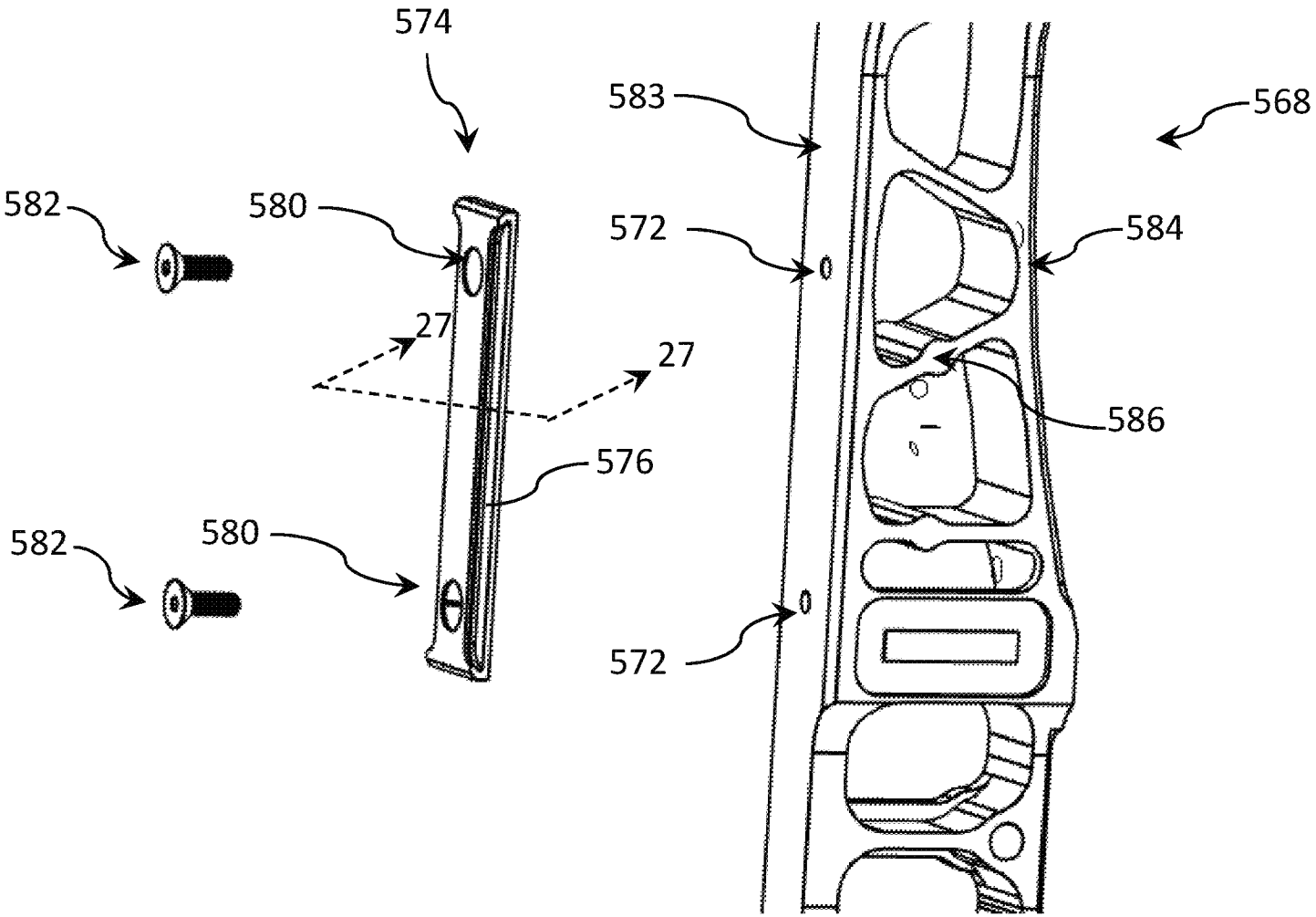
FIG. 27 is a rear, isometric view of the second bow riser of FIG. 24 and an embodiment of an adapter rail aligned for attachment to the second bow riser.
Figure 28:
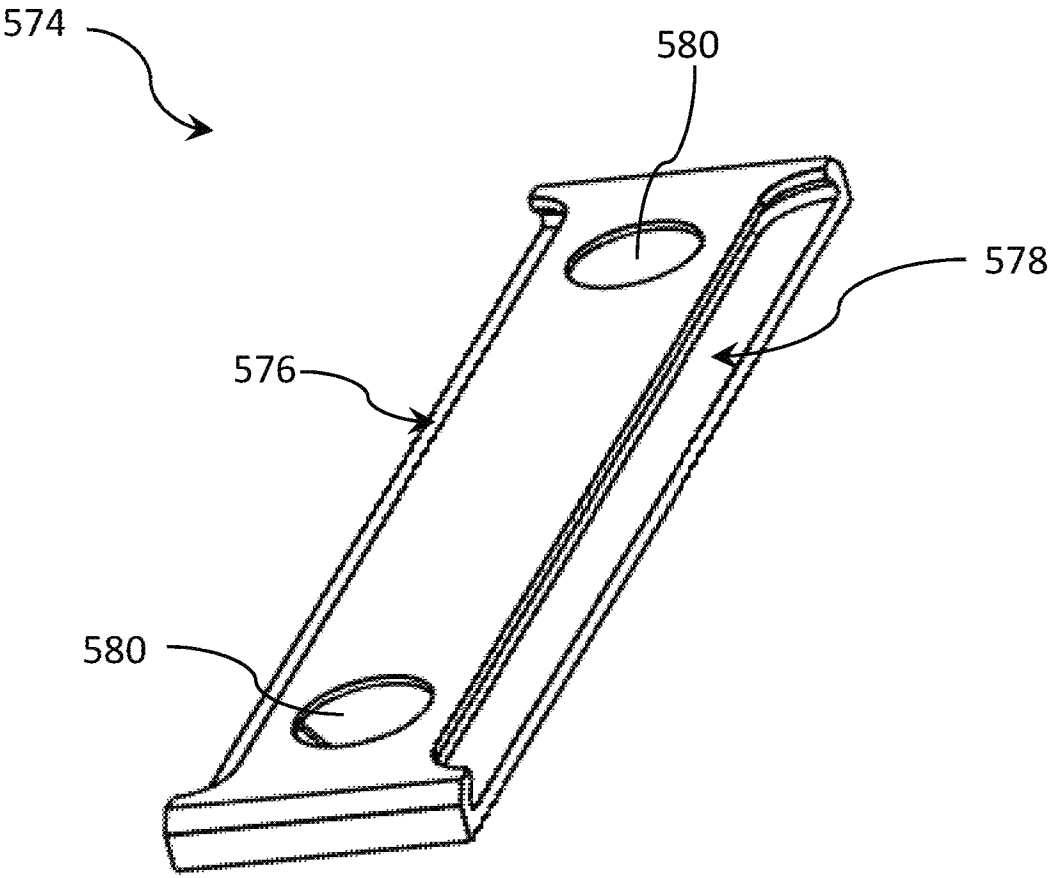
FIG. 28 is an enlarged, isometric view of the adapter rail shown in FIG. 27.
Figure 29:
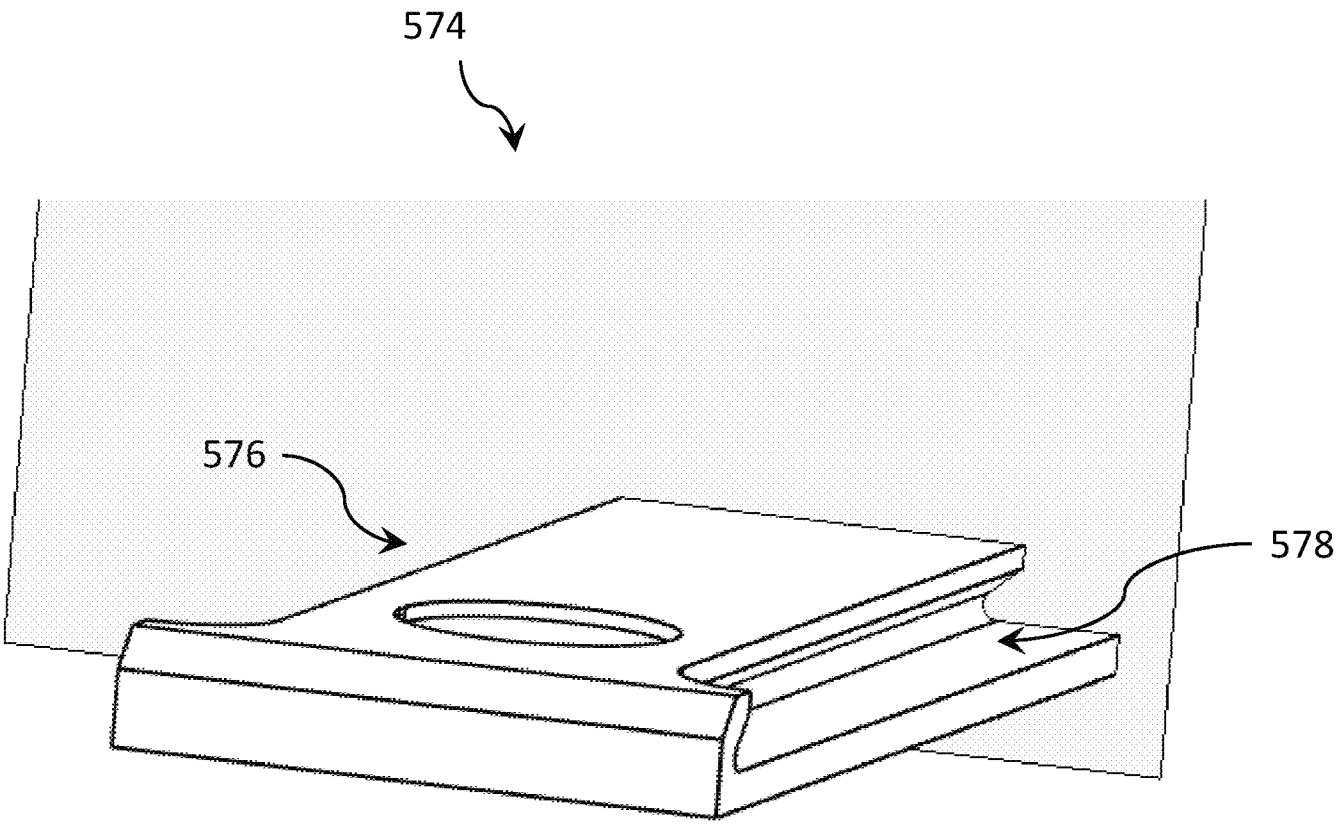
FIG. 29 is a cross-sectional view of the adapter rail of FIG. 27, taken substantially along lines 27-27 of FIG. 27.
Figure 30:
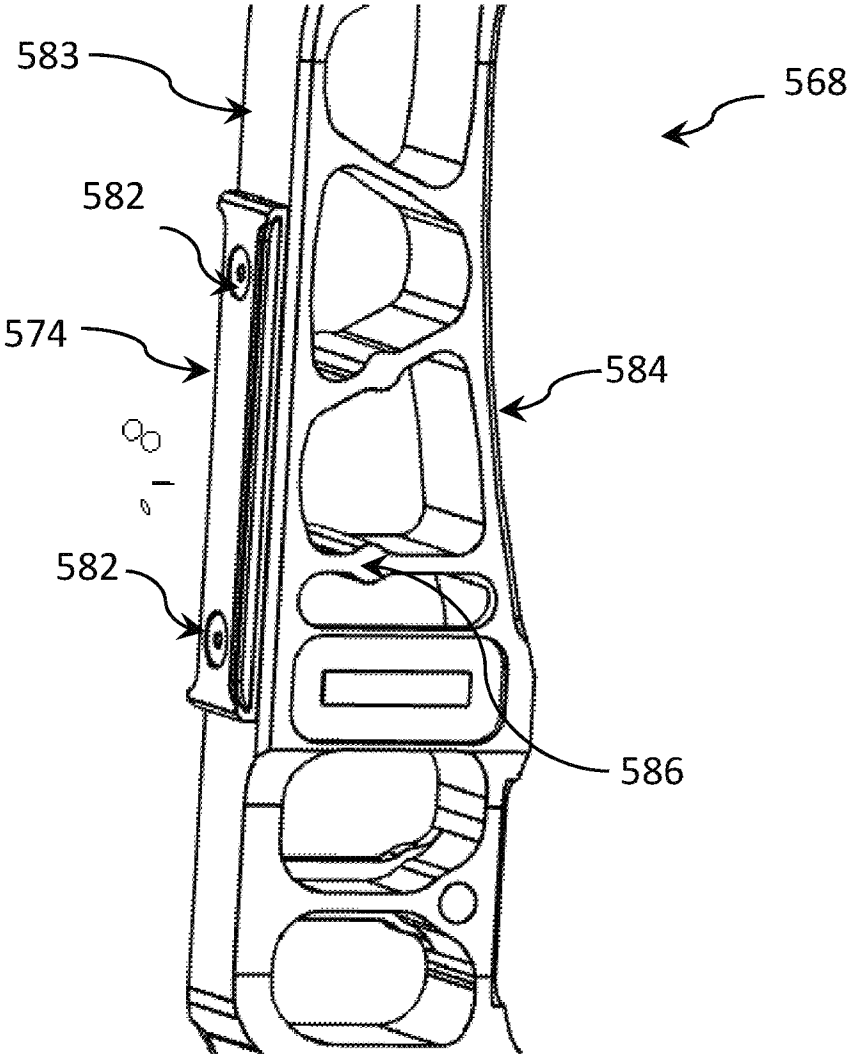
FIG. 30 is an isometric view of the adapter rail of FIG. 27 mounted to the second bow riser of FIG. 27.

Referring to FIGS. 24-26, in an embodiment, the body 518 includes the bow riser 568. Bow riser 568 has edges (such as left edge 570) that lack the slots 36' and 36 of bow riser 566. In addition, the bow riser 568 defines a plurality of openings, such as threaded adapter holes 572. For this embodiment, an adapter rail 574 is configured to be coupled to the bow riser 568.

As shown in FIGS. 27-30, the adapter rail 574 defines: (a) a left rail slot 576; (b) a right rail slot 578; and (c) a plurality of rail openings 580. A user can couple or mount the adapter rail 574 to the bow riser 568 by inserting a plurality of fasteners 582 through the rail openings 580 and into the threaded adapter holes 572 of the bow riser 568. After rotating the fasteners 582, the adapter rail 574 will be screwed onto and secured to the bow riser 568. The addition of the adapter rail 574 to the bow riser 568 converts the bow riser 568 to a configuration that is matingly compatible with the archery mounting assembly 510. In particular, the rail slots 576, 578 enable the bow riser 568 to be securely and adjustably clamped by the archery mounting assembly 510, as described above.

In the illustrated embodiment, the adapter rail 574 is attached to the rear surface 583 of the bow riser 568. In other embodiments not shown, the adapter rail 574 can be attached to the front surface 584, left side surface 586 or right side surface 588 of the bow riser 568.

Figure 31:
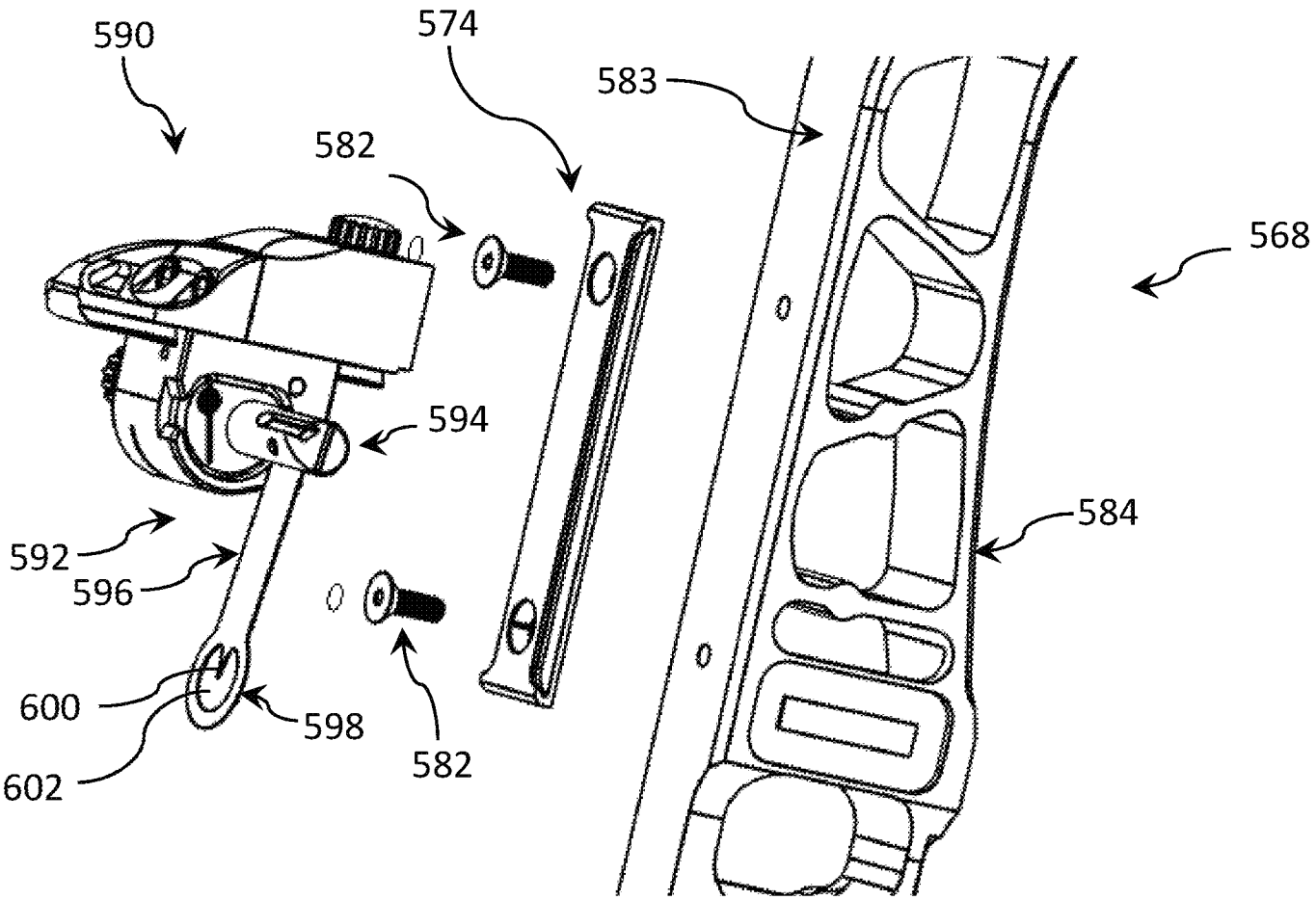
FIG. 31 is an exploded, isometric view of an accessory system, the adapter rail of FIG. 27, and the second bow riser of FIG. 24, illustrating the optical window, target tracker and vision space of such accessory system.
Figure 32:
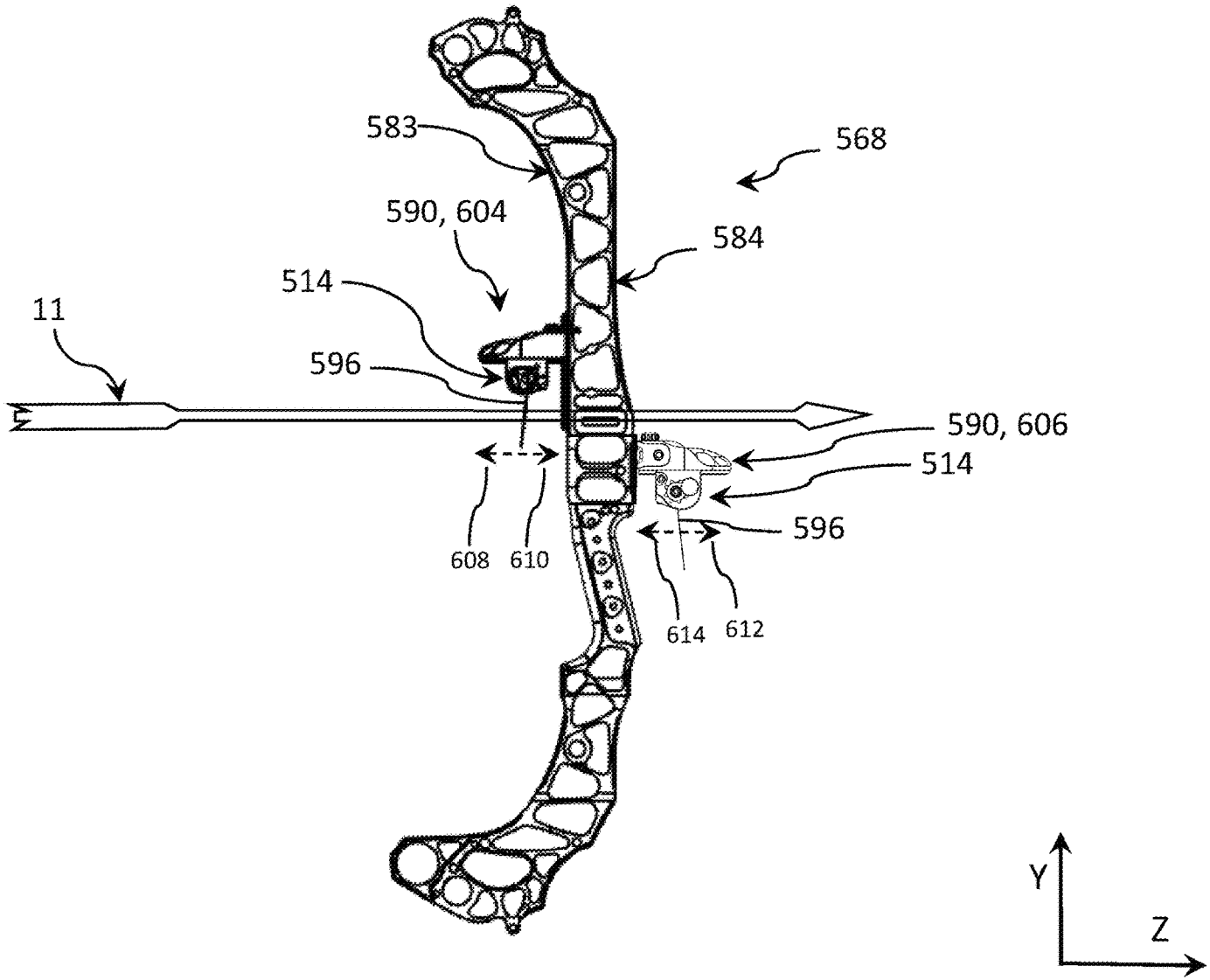
FIG. 32 is a left side elevation view of an embodiment of a bow riser having: (a) the archery accessory system of FIG. 31 mounted to the rear surface (directly or through an adapter rail) of the bow riser; and (b) another accessory system (identical to the archery accessory system of FIG. 31) mounted to the front surface (directly or through an adapter rail) of the bow riser.

Referring to FIGS. 31-32, in an embodiment, an accessory system 590 is configured to be coupled or mounted to the rear surface 583 of the bow riser 568. In this embodiment, the archery accessory system 590 has the same elements, structure and functionality as the archery accessory system 100 (FIG. 4) with the replacement of the projectile support device 300 with the sight device 592. The sight device 592 has the same elements, structure and functionality as the projectile support device 300 except that the accessory retainer 380 and archery device 390 of the projectile support device 300 are replaced with the accessory retainer 594 and the sight member 596.

The accessory retainer 594 securely holds the sight member 596. The sight member 596 has an optical window 598. The optical window has a target tracker 600 positioned within a vision space 602 defined by the optical window 598. In operation, the user can rotate the sight member 596 relative to the bow riser 568 until reaching the desired position for aiming at the target 524 (FIG. 19). The target tracker 600 enables the user to increase aiming accuracy.

As illustrated in FIG. 32, the archery accessory system 604 can be mounted to the rear surface 583, directly or through the adapter rail 574 attached to the rear surface 583. When the archery accessory system 604 is mounted to the rear surface 583, directly or through the adapter rail 574, the accessory support 514 is configured to be alternately moved, along the adjustment axis Z, in an outbound direction 608 (e.g., rearward) and an inbound direction 610 (e.g., forward), in each case, relative to the bow riser 568. When the archery accessory system 606 is mounted to the front surface 584, directly or through the adapter rail 574, the accessory support 514 is configured to be alternately moved, along the adjustment axis Z, in an outbound direction 612 (e.g., forward) and an inbound direction 614 (e.g., rearward), in each case, relative to the bow riser 568.

Figure 33:
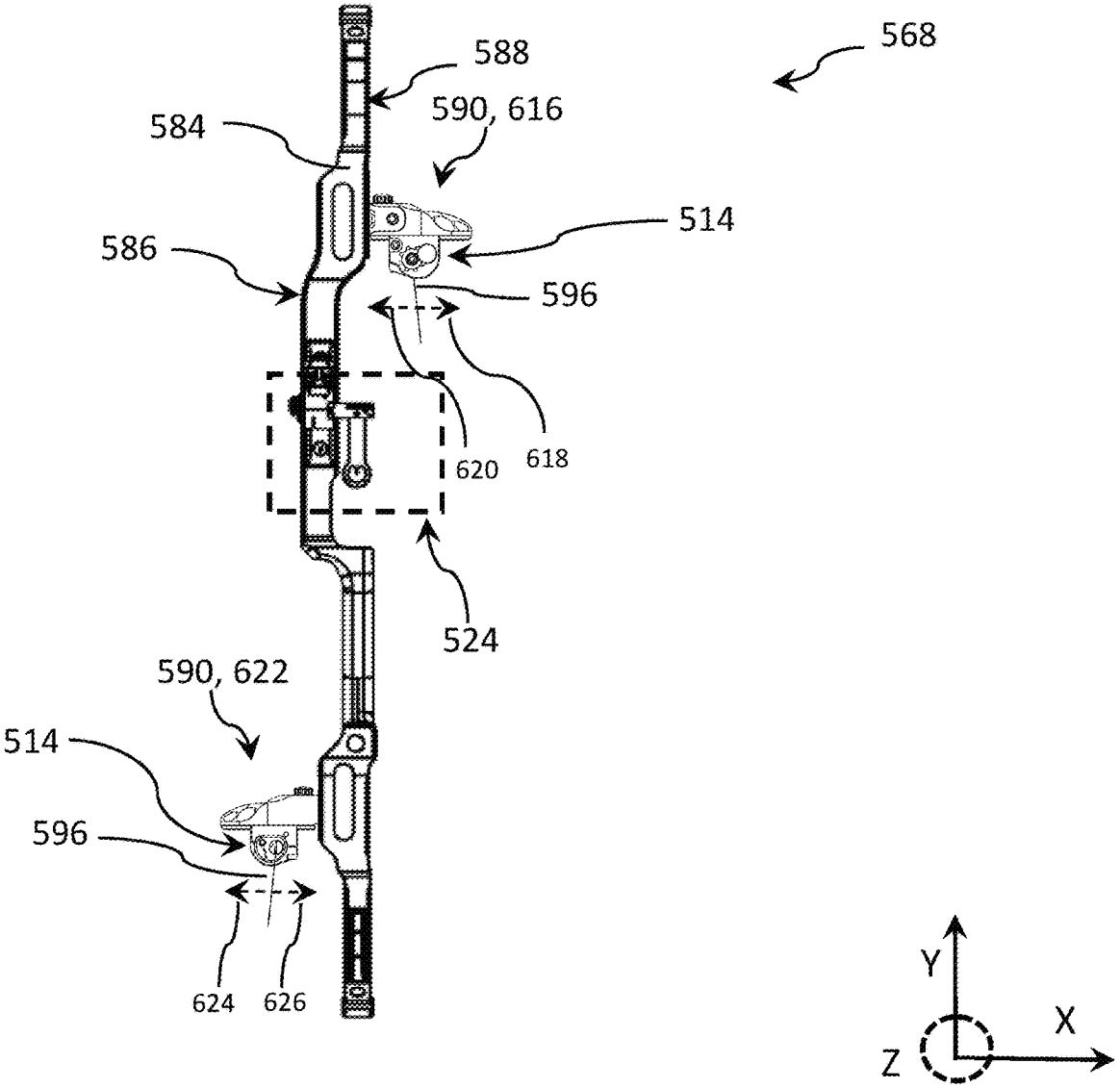
FIG. 33 is a front view of an embodiment of a bow riser having: (a) the archery accessory system of FIG. 31 mounted to the left side surface (directly or through an adapter rail) of the bow riser; and (b) another accessory system (identical to the archery accessory system of FIG. 31) mounted to the right side surface (directly or through an adapter rail) of the bow riser.

As illustrated in FIG. 33, the archery accessory system 616 is configured to be mounted to the right side surface 588, directly or through the adapter rail 574 attached to the right side surface 588. When the archery accessory system 616 is mounted to the right side surface 588, directly or through the adapter rail 574, the accessory support 514 is configured to be alternately moved, along the adjustment axis X, in an outbound direction 618 (e.g., rightward) and an inbound direction 620 (e.g., leftward), in each case, relative to the bow riser 568. When the archery accessory system 622 is mounted to the left side surface 586, directly or through the adapter rail 574, the accessory support 514 is configured to be alternately moved, along the adjustment axis X, in an outbound direction 624 (e.g., leftward) and an inbound direction 626 (e.g., rightward), in each case, relative to the bow riser 568.

The parts, components, and structural elements of each of the archery accessory systems 100, 604, 606, 616, 622, the adapter 50, and the adapter rail 574 can be combined into an integral or unitary, one-piece object through welding, soldering, plastic molding other methods, or such parts, components, and structural elements can be distinct, removable items that are attachable to each other through screws, bolts, pins and other suitable fasteners.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery mounting assembly comprising:

a mount device comprising:

a mount portion configured to be engaged with a body of an archery weapon, wherein the archery weapon is aimable toward a target located forward of the archery weapon, wherein a vertical plane extends through the target; and a first interface that extends at least partially along an adjustment axis, wherein, when the archery weapon is aimed at the target while the mount portion is engaged with the body:

the adjustment axis intersects with the vertical plane; and the adjustment axis is oriented to extend into the body; and an accessory support comprising:

a support portion configured to support an archery accessory; and a second interface configured to be movably coupled to the first interface of the mount device, wherein, when the mount portion is engaged with the body, the accessory support is configured to be moved, along the adjustment axis, in a plurality of different directions relative to the body.

2. The archery mounting assembly of claim 1, wherein the mount portion comprises a clamp configured to engage and compress a portion of the body of the archery weapon.

3. The archery mounting assembly of claim 1, wherein:

the mount portion defines an opening; and the archery mounting assembly comprises a fastener, the fastener is configured to extend through the opening to couple the mount portion to the body of the archery weapon.

4. The archery mounting assembly of claim 1, wherein:

the body of the archery weapon comprises a plurality of body surfaces;

the body surfaces comprise: (a) a front surface configured to at least partially face the target; (b) a rear surface configured to at least partially face away from the target; and (c) a plurality of side surfaces; and the mount portion is configured to be engaged with one of the body surfaces of the archery weapon.

5. The archery mounting assembly of claim 1, wherein:

the body of the archery weapon comprises a rear surface configured to at least partially face away from the target when the archery weapon is aimed at the target; and the mount portion comprises a mounting surface configured to face and be secured to the rear surface when the mount portion is engaged with the body.

6. The archery mounting assembly of claim 1, wherein:

the mount portion comprises a body engagement surface configured to be engaged with a portion of the body of the archery weapon; and the body engagement surface extends, at least partially, along the vertical plane when the archery weapon is aimed toward the target.

7. The archery mounting assembly of claim 1, wherein the plurality of different directions comprise:

an inbound direction toward the body of the archery weapon; and an outbound direction away from the body of the archery weapon.

8. The archery mounting assembly of claim 1, wherein each of the first and second interfaces comprises one of: (a) a structure defining a slot; or (b) a protrusion configured to fit within a slot.

9. The archery mounting assembly of claim 1, wherein:

the first and second interfaces comprise at least one gear element; and the archery mounting assembly comprises at least one position control device operatively coupled to the at least one gear element.

10. The archery mounting assembly of claim 1, wherein the archery mounting assembly comprises at least one position locking device operatively coupled to at least one of the first and second interfaces.

11. The archery mounting assembly of claim 1, wherein the support portion comprises an accessory holder.

12. An archery accessory system comprising the archery mounting assembly of claim 1, wherein the accessory comprises one of an arrow rest device, a bow sight device, an arrow quiver device, a stabilizer device, a scope device, a light source device, a sensor device, or an energy generator.

13. An archery accessory system comprising the archery mounting assembly of claim 1, wherein the accessory comprises an arrow rest device.

14. The archery mounting assembly of claim 1, wherein:

the body of the archery weapon comprises a rear surface configured to at least partially face away from the target when the archery weapon is aimed at the target; and the mount portion comprises a mounting surface that physically contacts the rear surface when the mount portion is engaged with the body.

15. An archery mounting assembly comprising:

a mount device comprising:

a mount portion configured to be engaged with a body of an archery weapon, wherein the archery weapon is aimable at a target through which a plane extends; and a first interface that extends at least partially along an adjustment axis, wherein, when the mount portion is engaged with the body while the archery weapon is aimed at the target, the adjustment axis is oriented to extend into the body and intersect with the plane; and an accessory support comprising:

a support portion configured to support an archery accessory; and a second interface configured to be movably coupled to the first interface of the mount device so that, when the mount portion is engaged with the body, the second interface is configured to be moved, along the adjustment axis, relative to the body.

16. The archery mounting assembly of claim 15, wherein:

the body of the archery weapon comprises a rear surface configured to at least partially face away from the target when the archery weapon is aimed at the target; and the mount portion comprises a mounting surface configured to face and be secured to the rear surface when the mount portion is engaged with the body.

17. The archery mounting assembly of claim 15, wherein:

the archery weapon is configured to be aimed at the target;

the body of the archery weapon comprises a plurality of body surfaces;

the body surfaces comprise: (a) a front surface configured to at least partially face the target; (b) a rear surface configured to at least partially face away from the target; and (c) a plurality of side surfaces; and the mount portion is configured to be engaged with one of the body surfaces of the archery weapon.

18. The archery mounting assembly of claim 15, wherein the mount portion comprises a clamp configured to engage and compress a portion of the body of the archery weapon.

19. The archery mounting assembly of claim 15, wherein:

the mount portion defines an opening; and the archery mounting assembly comprises a fastener, the fastener is configured to extend through the opening to couple the mount portion to the body of the archery weapon.

20. The archery mounting assembly of claim 15, wherein:

the second interface is configured to be moved in a plurality of different directions relative to the body; and the plurality of different directions comprise:

an inbound direction toward the body of the archery weapon; and an outbound direction away from the body of the archery weapon.

21. The archery mounting assembly of claim 15, wherein each of the first and second interfaces comprises one of: (a) a structure defining a slot; or (b) a protrusion configured to fit within a slot.

22. The archery mounting assembly of claim 15, wherein:

the first and second interfaces comprise at least one gear element; and the archery mounting assembly comprises at least one position control device operatively coupled to the at least one gear element.

23. An archery accessory system comprising the archery mounting assembly of claim 15, wherein the accessory comprises an arrow rest device.

24. The archery mounting assembly of claim 15, wherein:

the body of the archery weapon comprises a rear surface configured to at least partially face away from the target when the archery weapon is aimed at the target; and the mount portion comprises a mounting surface that physically contacts the rear surface when the mount portion is engaged with the body.

25. A method for manufacturing an archery mounting assembly, the method comprising:

structuring a mount device to comprise:

a mount portion structured to be engaged with a body of an archery weapon, wherein the archery weapon is aimable at a target through which a plane extends; and a first interface that extends at least partially along an adjustment axis, wherein, when the mount portion is engaged with the body while the archery weapon is aimed at the target, the adjustment axis is oriented to extend into the body and intersect with the plane; and structuring an accessory support to comprise:

a support portion structured to support an archery accessory; and a second interface structured to be movably coupled to the first interface of the mount device so that, when the mount portion is engaged with the body, the second interface is configured to be moved, along the adjustment axis, relative to the body.

26. The method of claim 25, wherein:

the body of the archery weapon comprises a rear surface configured to at least partially face away from the target when the archery weapon is aimed at the target; and the structuring of the mount device comprises structuring the mount portion so as to comprise a mounting surface that is configured to face and be secured to the rear surface when the mount portion is engaged with the body.

27. The method of claim 25, wherein:

the archery weapon is structured to be aimed at the target;

the body of the archery weapon comprises a plurality of body surfaces; and the body surfaces comprise: (a) a front surface structured to at least partially face the target;

(b) a rear surface structured to at least partially face away from the target; and (c) a plurality of side surfaces, wherein the method comprises:

structuring the mount portion to be engaged with one of the body surfaces of the archery weapon; and structuring the second interface to be moved in a plurality of different directions relative to the body, wherein the plurality of different directions comprise:

an inbound direction toward the body of the archery weapon; and an outbound direction away from the body of the archery weapon.

28. The method of claim 25, wherein the step of structuring the accessory support comprises structuring the support portion to support an arrow rest device.

29. The method of claim 25, comprising:

structuring the body of the archery weapon to comprise a rear surface configured to at least partially face away from the target when the archery weapon is aimed at the target; and structuring the mount portion to comprise a mounting surface that physically contacts the rear surface when the mount portion is engaged with the body.

* * * * *